US010717168B2

(12) United States Patent
Brown et al.

(10) Patent No.: US 10,717,168 B2
(45) Date of Patent: Jul. 21, 2020

(54) GLASS TREATMENT APPARATUS AND METHODS OF TREATING GLASS

(71) Applicant: Corning Incorporated, Corning, NY (US)

(72) Inventors: James William Brown, Painted Post, NY (US); Yu-Chang Hong, Taichung (TW); Chih-Hung Lee, Kaohsiung (TW); Naiyue Zhou, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 7 days.

(21) Appl. No.: 15/120,209

(22) PCT Filed: Feb. 23, 2015

(86) PCT No.: PCT/US2015/017013
§ 371 (c)(1),
(2) Date: Aug. 19, 2016

(87) PCT Pub. No.: WO2015/130586
PCT Pub. Date: Sep. 3, 2015

(65) Prior Publication Data

US 2017/0057044 A1 Mar. 2, 2017

Related U.S. Application Data

(60) Provisional application No. 61/946,224, filed on Feb. 28, 2014.

(51) Int. Cl.
*B24B 7/24* (2006.01)
*B24B 9/10* (2006.01)

(52) U.S. Cl.
CPC ..... *B24B 7/242* (2013.01); *B24B 9/102* (2013.01)

(58) Field of Classification Search
CPC ..... B24B 7/24; B24B 27/033; B24B 7/00; B24B 3/02; B24B 1/00; B24B 37/04; B24B 49/00; B24B 51/00
(Continued)

(56) References Cited

U.S. PATENT DOCUMENTS 1,755,140 A * 4/1930 Waldron ..... B24B 7/24 451/260
3,167,893 A 2/1965 Giardini et al.
(Continued)

FOREIGN PATENT DOCUMENTS

CN 2141346 Y * 9/1993
CN 2789249 Y 6/2006
(Continued)

OTHER PUBLICATIONS

Machine translation of CN 2141346 Y.*
(Continued)

*Primary Examiner* — George B Nguyen

(57) ABSTRACT

A glass treatment apparatus comprise at least one upstream working device including a working wheel configured to rotate such that a working surface of the working wheel machines a surface portion of a glass sheet. The glass treatment apparatus further includes a downstream working device includes a working wheel comprising a cleaning wheel. In further examples, methods of treating glass comprise the step of machining a surface portion of a glass sheet with a working surface of a first rotating working wheel and the step of machining the surface portion of the glass sheet with a working surface of a second rotating working wheel comprising a cleaning wheel.

29 Claims, 15 Drawing Sheets

(58) Field of Classification Search
USPC ..... 451/44
See application file for complete search history.

(56) References Cited

U.S. PATENT DOCUMENTS

| | | | | |
|---|---|---|---|---|
| 4,667,443 | A | 5/1987 | Sakurai et al. | |
| 4,929,130 | A | 5/1990 | Diebolt et al. | |
| 6,428,390 | B1 | 8/2002 | Clark et al. | |
| 7,001,249 | B1 | 2/2006 | Pride et al. | |
| 7,018,272 | B2 | 3/2006 | Allaire et al. | |
| 7,125,319 | B2 | 10/2006 | Brown et al. | |
| 7,207,866 | B2 | 4/2007 | Allaire et al. | |
| 7,294,045 | B1 | 11/2007 | Brown et al. | |
| 8,262,436 | B2 | 9/2012 | De Gobbi | |
| 8,585,467 | B2 | 11/2013 | Brown et al. | |
| 8,602,848 | B2 | 12/2013 | Moon et al. | |
| 8,753,173 | B2 * | 6/2014 | Linnenbruegger | B24B 55/02 451/194 |
| 2005/0090189 | A1 | 4/2005 | Brown et al. | |
| 2007/0141961 | A1 | 6/2007 | Brown et al. | |
| 2010/0112910 | A1 | 5/2010 | Brown et al. | |
| 2013/0040541 | A1 * | 2/2013 | Mader | B65G 21/209 451/442 |
| 2013/0130597 | A1 * | 5/2013 | Brown | B24B 55/04 451/44 |

FOREIGN PATENT DOCUMENTS

| | | | |
|---|---|---|---|
| DE | 202005018051 | U1 | 3/2006 |
| KR | 101121208 | B1 | 8/2007 |
| TW | 201034798 | A | 10/2010 |

OTHER PUBLICATIONS

PCT/US2015/014013 International Search Report of the International Searching Authority; dated May 29, 2016; 5 pages; EPO.
TW104106089 Search Report dated Jul. 5, 2018; 1 Page; Taiwan Patent Office.
English Translation of JP2016554256 Office Action dated Dec. 5, 2018; 3 Pages; Japanese Patent Office.
English Translation of CN2141346 dated Sep. 1, 1993; 5 Pages.

* cited by examiner

GLASS TREATMENT APPARATUS AND METHODS OF TREATING GLASS

This application claims the benefit of priority under 35 U.S.C. § 371 of International Application Serial No. PCT/US15/17013, filed on Feb. 23, 2015, which, in turn, claims the benefit of priority of U.S. Provisional Patent Application Ser. No. 61/946,224, filed on Feb. 28, 2014, the contents of which are relied upon and incorporated herein by reference in their entireties as if fully set forth below.

TECHNICAL FIELD

The disclosure relates generally to a glass treatment apparatus and methods and, more particularly, to glass treatment apparatus and methods for machining a surface of a glass sheet while maintaining the pristine surfaces of the glass sheet.

BACKGROUND

It is known to fusion draw glass ribbon from a fusion draw machine. The ribbon is typically further processed into glass sheets that may be used to generate various liquid crystal display configurations. During processing, it is often desired to finish the edges of the glass sheet or glass ribbon to remove sharp edges and/or other defects. There is a need to carry out such finishing techniques while maintaining the pristine surfaces of the glass sheet. Sheet edge finishing is critical to improve the edge profile and strength required for handling and the customer's panel making process.

SUMMARY

The following presents a simplified summary of the disclosure in order to provide a basic understanding of some example aspects described in the detailed description.

In a first example aspect of the disclosure, a glass treatment apparatus comprises at least one upstream working device including a working wheel configured to rotate such that a working surface of the working wheel machines a surface portion of a glass sheet. The at least one upstream working device further includes a shroud substantially circumscribing the working wheel. The glass treatment apparatus further includes a downstream working device positioned downstream from the at least one upstream working device. The downstream working device includes a working wheel comprising a cleaning wheel. The cleaning wheel is configured to rotate such that a working surface of the cleaning wheel machines the surface portion of the glass sheet by cleaning the surface portion of the glass sheet to remove debris generated by machining the surface portion of the glass sheet with the at least one upstream working device.

In one example of the first aspect, the shroud includes a slot configured to receive the surface portion of the glass sheet.

In another example of the first aspect, the downstream working device further includes a shroud substantially circumscribing the cleaning wheel. For example, the shroud includes a slot configured to receive the surface portion of the glass sheet.

In still another example of the first aspect, the working wheel of the at least one upstream working device comprises a grinding wheel.

In yet another example of the first aspect, the working wheel of the at least one upstream working device comprises a polishing wheel.

In a further example of the first aspect, at least one upstream working device comprises a first upstream working device and a second upstream working device. The working wheel of the first upstream working device comprises a grinding wheel and the working wheel of the second upstream working device comprises a polishing wheel. The second upstream working device is positioned midstream between the first upstream working device and the downstream working device.

In still a further example of the first aspect, the apparatus includes a fluid dispensing device configured to direct a laminar fluid film along a major surface of the glass sheet. Still further, the glass treatment apparatus may optionally include another fluid dispensing device configured to direct fluid along another major surface of the glass sheet.

In another example of the first aspect, the working surface of at least one of the working wheel and the cleaning wheel comprises an outer peripheral surface of the wheel.

The first aspect may be carried out alone or in combination with one or more of the examples of the first aspect discussed above.

In a second example aspect of the disclosure, a glass treatment apparatus comprises at least one upstream working device including a working wheel configured to rotate such that a working surface of the working wheel machines a surface portion of a glass sheet. The at least one upstream working device further includes a fluid dispensing device configured to direct a laminar fluid film along a major surface of the glass sheet. The glass treatment apparatus further includes a downstream working device positioned downstream from the at least one upstream working device. The downstream working device includes a working wheel comprising a cleaning wheel. The cleaning wheel is configured to rotate such that a working surface of the cleaning wheel machines the surface portion of the glass sheet by cleaning the surface portion of the glass sheet to remove debris generated by machining the surface of the glass sheet with the at least one upstream working device.

In one example of the second aspect, the at least one upstream working device further comprises another fluid dispensing device configured to direct fluid along another major surface of the glass sheet.

In another example of the second aspect, the downstream working device includes a fluid dispensing device configured to direct a laminar fluid film along the major surface of the glass sheet. In a further example, the downstream working device includes another fluid dispensing device configured to direct fluid along another major surface of the glass sheet.

In still another example of the second aspect, the at least one upstream working device comprises a first upstream working device and a second upstream working device. The working wheel of the first upstream working device comprises a grinding wheel and the working wheel of the second upstream working device comprises a polishing wheel. The second upstream working device is positioned midstream between the first upstream working device and the downstream working device.

In yet another example of the second aspect, the working surface of at least one of the working wheel and the cleaning wheel comprises an outer peripheral surface of the wheel.

The second aspect may be carried out alone or in combination with one or more of the examples of the second aspect discussed above.

In a third example aspect of the disclosure, a method of treating glass comprises the step (I) of machining a surface portion of a glass sheet with a working surface of a first rotating working wheel while dispensing a substantially laminar flow of a first fluid film along a first fluid plane that lands on a first major surface of a glass sheet. Debris from machining the surface portion is entrained in the first fluid film traveling along the first major surface of the glass sheet and carried away from the glass sheet. The method then includes the step (II) of machining the surface portion of the glass sheet with a working surface of a second rotating working wheel comprising a cleaning wheel that machines the surface portion of the glass sheet by cleaning the surface portion of the glass sheet to remove further debris generated during step (I).

In one example of the third aspect, step (I) and step (II) each machine the surface portion of the glass sheet comprising an edge portion of the glass sheet.

In another example of the third aspect, step (I) comprises machining the surface portion of the glass sheet by polishing the surface portion of the glass sheet with the first rotating working wheel comprising a rotating polishing wheel.

In still another example of the third aspect, prior to step (I), the method further includes the step of machining the surface portion of the glass sheet by grinding the surface portion of the glass sheet with the first rotating working wheel comprising a rotating grinding wheel.

In yet another example of the third aspect, during step (I), the first fluid film lands on the first major surface of a glass sheet at a location outside of a shroud and the debris from machining the surface portion is entrained in the first fluid film inside the shroud. In another example, during step (I), the first fluid film travels through a slot in the shroud. In still another example, step (I) includes passing the first fluid film with the entrained debris through an exit port in the shroud.

In a further example of the third aspect, step (I) further comprises dispensing a substantially laminar flow of a second fluid film along a second fluid plane that lands on a second major surface of the glass sheet. Debris from machining the surface portion is entrained in the second fluid film traveling along the second major surface of the glass sheet and carried away from the glass sheet. In one example, during step (I), the second fluid film lands on the second major surface of a glass sheet at a location outside of a shroud and the debris from machining the surface portion is entrained in the second fluid film inside the shroud. For instance, during step (I), the second fluid film travels through a slot in the shroud. In another example, step (I) includes passing the second fluid film with the entrained debris through an exit port in the shroud.

In still another example of the third aspect, step (II) includes dispensing a substantially laminar flow of a first cleaning fluid film along a first cleaning fluid plane that lands on the first major surface of the glass sheet. At least portions of the further debris is entrained in the first cleaning fluid film traveling along the first major surface of the glass sheet and carried away from the glass sheet. In one example, step (II) further includes dispensing a substantially laminar flow of a second cleaning fluid film along a second cleaning fluid plane that lands on the second major surface of the glass sheet. At least portions of the further debris is entrained in the second cleaning fluid film traveling along the second major surface of the glass sheet and carried away from the glass sheet.

The third aspect may be carried out alone or in combination with one or more of the examples of the third aspect discussed above.

BRIEF DESCRIPTION OF THE DRAWINGS

These and other aspects are better understood when the following detailed description is read with reference to the accompanying drawings, in which.

DETAILED DESCRIPTION

Figure 1:
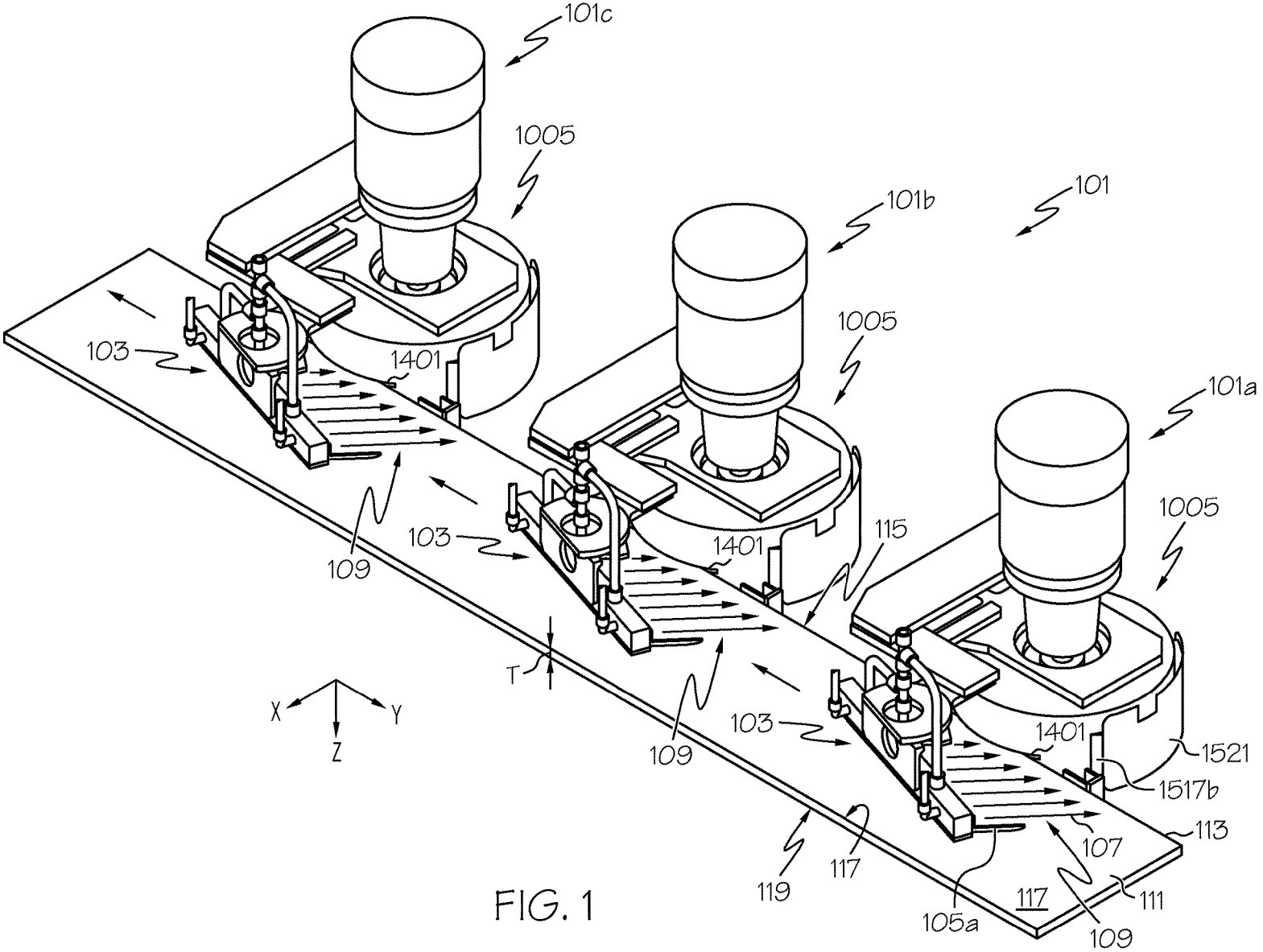
FIG. 1 is a perspective view of a glass treatment apparatus including at least one upstream working device and a downstream working device in accordance with one example of the disclosure.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example glass treatment apparatus 101 is provided with various example features that may be used either alone or in combination to help prevent particles from contaminating the pristine surfaces of a glass sheet 111. Features of the glass treatment apparatus and methods of treating glass may be similar or identical to features of the glass treatment apparatus and methods disclosed in U.S. Patent Application Publication No. 2013/0130597 that is herein incorporated by reference in its entirety.

In one example, the glass sheet 111 can comprise a glass ribbon, wherein the surface portion of the glass ribbon may be worked with the glass treatment apparatus 101 as the glass ribbon is produced (e.g. fusion drawn from a down-draw glass fusion device). In further examples, the glass sheet 111 can comprise a separated glass ribbon. For example, the glass sheet may comprise glass ribbon that is unrolled from a storage roll of glass ribbon. In still further examples, the glass sheet 111 can comprise separated portions of the glass ribbon. The glass sheets 111 (e.g., separated glass sheets) can be incorporated in a liquid crystal display wherein there is a desire to machine a surface portion, such as an edge portion 115 (e.g., a previously separated edge portion), to improve the edge quality of the glass sheet 111. As shown, the surface can comprise the outer peripheral edge 113 of the glass sheet 111 between the thickness "T" of the glass sheet 111 from a first major surface 117 and a second major surface 119 of the glass sheet 111. In addition or alternatively, the glass treatment apparatus 101 may be designed to machine a surface of the edge portion 115 comprising the first major surface 117 and/or the second major surface 119 without machining the outer peripheral edge 113 of the glass sheet 111. In further examples, one or both of the first major surface 117 and/or the second major surface 119 may be machined together with the outer peripheral edge 113 of the glass sheet 111. For example, the glass treatment apparatus 101 may be designed to provide an angled or rounded transition between the first major surface 117 and/or the second major surface 119 and the outer peripheral edge 113. Machining of the surface of the edge portion 115 of the glass sheet 111 can reduce the probability of stress fractures from forming and propagating to the interior portion of the glass sheet and/or may otherwise enhance the quality of the glass sheet 111.

The glass treatment apparatus 101 can include a downstream working device 101*c* and at least one upstream working device 101*a*, 101*b*. Throughout the disclosure, upstream, downstream, and midstream indicate process locations relative to one another. For example a glass treatment apparatus including an upstream working device and a downstream working device would be configured to machine a surface portion of a glass sheet with the upstream working device prior to machining the same surface portion of the glass sheet with the downstream working device. If the glass treatment apparatus also included a midstream working device, the glass treatment apparatus would be configured to sequentially machine the surface portion with the upstream working device, then the midstream working device, and then the downstream working device.

As shown in FIG. 1, the at least one upstream working device can comprise a first upstream working device 101*a* and a second upstream working device 101*b* although one or any plurality of upstream working devices may be provided in alternative examples. Other than the working wheel and/or unless otherwise indicated, the upstream working device(s) and the downstream working device can be substantially similar or identical although the working devices may be different sizes or have different alternative configurations in further examples. For illustration purposes, features of the first upstream working device 101*a* will be described in detail with respect to FIGS. 1-16 with the understanding that, unless otherwise indicated, similar or identical features may be provided for the downstream working device 101*c* and/or any remaining upstream working devices (e.g., 101*b*).

Figure 10:
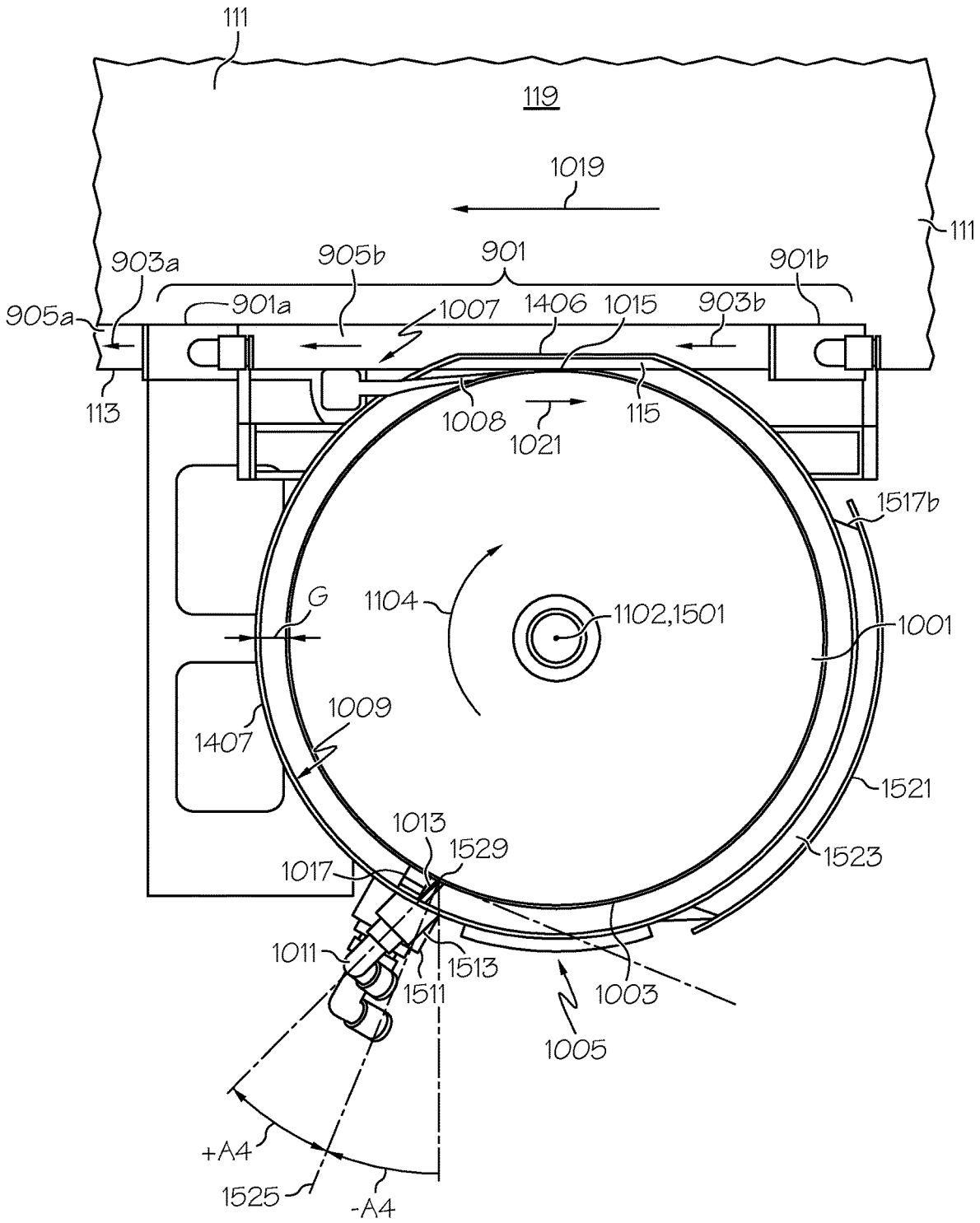
FIG. 10 is a bottom view of the illustrative working device of the fluid dispensing apparatus of FIG. 1.

Each working device 101*a*, 101*b*, 101*c* includes a working wheel 1001 illustrated schematically in FIG. 10. In one example, the working wheel 1001 of the first upstream working device 101*a* may comprise a grinding wheel while the working wheel of the second upstream working device 101*b* may comprise a polishing wheel. Although a single grinding wheel and a single polishing wheel is illustrated, two or more grinding wheels and/or two or more polishing wheels may be provided in further examples. For example, two or more grinding wheels may be arranged upstream, downstream and/or midstream with respect to one another. In addition or alternatively, two or more polishing wheels may be arranged upstream, midstream and/or downstream with respect to one another.

The at least one upstream working device can include a single working device with a single polishing wheel. For instance, the grinding procedure may not be carried out such that the surface portion is simply polished with a single working device. Alternatively, the grinding procedure may be carried out at a different location wherein the glass treatment apparatus 101 is only configured to polish and clean the glass sheet with the surface portion already ground at a remote location.

In another example, the at least one upstream working device can include a single working device with a single grinding wheel. For instance, the polishing procedure may be avoided altogether such that the surface portion is ground and then cleaned. Optionally, an additional polishing procedure may be subsequently carried out at a remote location.

In a further example, the at least one upstream working device can include a single working device that may include a plurality of working wheels, such as one or more grinding wheels and/or one or more polishing wheels. As such, rather than multiple independent working devices arranged upstream, midstream and downstream relative to one another, a single working device may be provided (e.g., with the wheels circumscribed by a single shroud) that includes the one or more grinding wheels and/or one or more polishing wheels and can also include the one or more cleaning wheels in still further examples.

In still a further example, the at least one upstream working device can include a single working device with a single working wheel that functions simultaneously as a grinding wheel and a polishing wheel. That is, a single working wheel may be provided to machine the surface portion of the glass sheet to complete shaping, removing artifacts, etc. from the surface portion prior to further machining to further work the surface portion of the glass sheet with a cleaning wheel to clean the surface portion of the glass sheet.

Throughout the disclosure a grinding wheel can be distinguished from a polishing wheel in that, compared to the polishing wheel, the grinding wheel is configured to remove a significantly larger amount of the surface portion (e.g., edge portion) of the glass sheet to remove imperfections in the surface portion such as microcracks that may otherwise weaken the surface portion of the glass sheet. In addition or alternatively, the grinding wheel may reshape (e.g., bevel) the surface portion of the glass sheet. In one example grinding procedure, if the surface portion comprises an edge portion of the glass sheet, the grinding wheel may remove outer edge portions of the glass sheet to remove microcracks or other edge imperfections that would otherwise weaken the glass sheet. Moreover, the edge portion may optionally be beveled to remove the sharp corners (e.g., 90° angles) that may exist between the outer peripheral edge 113 and the major surfaces 117, 119 of the glass sheet. By removing the relatively sharp corners, further stress concentrations at the outer peripheral edge 113 can be avoided to further strengthen the edge portions of the glass sheet.

The polishing wheel, when compared to the grinding wheel, is configured to remove a significantly smaller amount of the surface portion (e.g., edge portion). Indeed, the polishing wheel may be designed to remove artifacts left behind by the grinding wheel. As such, while the grinding wheel may remove major surface imperfections and can even reshape (e.g., bevel) the outer peripheral edge 113, the polishing wheel may remove artifacts such as minor surface imperfections generated by the grinding wheel. By removing such artifacts, it is possible to even further refine the surface quality of the surface portion (e.g., edge portion) of the glass sheet and therefore even further strengthen the edge portion of the glass sheet. As such, unlike the grinding wheel, the polishing wheel may be configured to remove very small amounts of the surface portion and leaves the general shape of the surface portion of the glass sheet intact.

Various grinding wheels and/or polishing wheels may be provided in accordance with aspects of the disclosure. In one example, the grinding wheel and/or polishing wheel include diamond particles (e.g., 400 mesh diamond particles) with desired structural characteristics designed to carry out a grinding or a polishing procedure. In further examples, the diameter of the grinding wheel may be different or the same as the diameter of the polishing wheel. For instance, the grinding wheel may optionally include a larger diameter than the polishing wheel. Moreover, in operation, the polishing wheel may have a higher rotational velocity than the grinding wheel although the polishing wheel may have substantially the same or even a lower rotational velocity than the grinding wheel in further examples.

As mentioned previously and further schematically illustrated in FIG. 10, the working wheel 1001 of the downstream working device 101*c* comprises a cleaning wheel. Although a single cleaning wheel is illustrated, two or more cleaning wheels may be arranged upstream, midstream and/or downstream with respect to one another. Throughout the disclosure a cleaning wheel can be distinguished from a grinding wheel and a polishing wheel in that, compared to the grinding wheel and polishing wheel, the cleaning wheel is designed to clean the surface portion from particles generated during a prior grinding and/or polishing procedure(s) without significant (or any) further removal of glass from the surface portion of the glass sheet.

Various cleaning wheels may be provided in accordance with aspects of the disclosure. In one example, the cleaning wheel comprises SiC media (e.g., 400 mesh SiC media). In another example, the cleaning wheel can comprise a polymer or rubber bonded wheel. In still further examples, the cleaning wheel can comprise felt, cloth and/or other textile-type materials.

As such, although a wide range of configurations are possible, the illustrated glass treatment apparatus 101 can include the first upstream working device 101*a* including a grinding wheel configured to grind the surface portion 113, and a second upstream working device 101*b* positioned downstream from the first upstream working device 101*a*. The second upstream working device 101*b* includes a polishing wheel configured to polish the surface portion 113. The example illustrated glass treatment apparatus 101 further includes a downstream working device 101*c* positioned downstream from the second upstream working device 101*b* such that the second upstream working device 101*b* is positioned midstream between the first upstream working device 101*a* and the downstream working device 101*c*.

In operation, the working wheel (e.g., grinding wheel, polishing wheel) of the at least one upstream working device 101*a*, 101*b* is configured to rotate such that a working surface of the working wheel machines the surface portion of the glass sheet. For example, in the illustrated embodiment shown in FIG. 1, the first upstream working device 101*a* includes a grinding wheel configured to rotate such that the grinding working surface of the grinding wheel machines (i.e., grinds) the surface portion of the glass sheet. As further illustrated in FIG. 1, the second upstream working device 101*b* includes a polishing wheel configured to rotate such that the polishing working surface of the polishing wheel machines (i.e., polishes) the surface portion of the glass sheet. As shown, the grinding/polishing surface of the grinding/polishing wheel can comprise an outer peripheral surface of the grinding/polishing wheel although other surfaces of the grinding/polishing wheel may be provided in further examples.

Still further, in operation, the working wheel (i.e., cleaning wheel) of the downstream working device 101*c* is configured to rotate such that the working surface (i.e., cleaning surface) of the cleaning wheel machines (i.e., cleans) the surface portion of the glass sheet to remove debris generated by machining the surface portion of the glass sheet with the at least one upstream working device 101*a*, 101*b*. As shown, the cleaning surface of the working wheel can comprise an outer peripheral surface of the cleaning wheel although other surfaces of the cleaning wheel may be provided in further examples.

Any of the upstream working devices and/or downstream working device may include the illustrated shroud 1005 discussed more fully below. For example, optionally, both the first upstream working device 101*a* and second upstream working device 101*b* may include the shroud 1005 that circumscribes the working wheel. Optionally, the downstream working device 101*c* may also include the shroud 1005 that circumscribes the working wheel. As discussed more fully below, the shroud can include a slot 1401 configured to receive the surface portion (e.g., edge portion) of the glass sheet. The slot can optionally include an adjustable slot to accommodate glass sheets with different thicknesses and fine-tune the slot size such that the fluid films 109, 905*b* may pass through the slot while minimizing the space above the fluid film 109 and below the fluid film 905*b*.

As discussed below, any of the upstream working devices and/or downstream working device can include a fluid dispensing device 103 configured to direct a fluid film, such as a laminar fluid film, along the first major surface 117 of the glass sheet. In addition or alternatively, any of the upstream working devices and/or downstream working device may include another fluid dispensing device 901 configured to direct fluid, such as a fluid film (e.g., laminar fluid film) along the second major surface 119 of the glass sheet.

Although not required, as shown in FIG. 1, the illustrated example the glass treatment apparatus 101 is shown machining a glass sheet 111 that is in a substantially horizontal orientation wherein the glass sheet 111 extends substantially along the illustrated X-Y plane with the force of gravity acting in the Z direction. In further examples, the glass sheet may be oriented at an incline relative to the X-Y orientation and, in some examples, may be oriented along the X-Z and/or Y-Z plane. Regardless of the orientation, one of many fluid dispensing devices may be used to dispense a substantially laminar flow of a fluid film along the first major surface 117 and/or the second major surface 119 of the glass sheet to help prevent particles from contaminating the pristine major surfaces 117, 119 of the glass sheet 111. Aspects of the disclosure may be useful to remove various species of particles such as a relatively large particle species having a maximum dimension of greater than 3 microns and relatively small particle species having a maximum dimension of less than about 3 microns, such as from about 1 micron to about 3 microns.

A substantially laminar flow of fluid film may include small portions that are not in laminar flow but includes a substantial portion of the flow in laminar flow. For instance, a substantially laminar flow can include one or more relatively small areas of the fluid film may include eddies or other flow disturbances while the remaining portions of the fluid film are in a substantially laminar flow. Providing a fluid film in laminar flow can be used to overcome the particle sources and particle dynamics typically observed during the machining process. Indeed, the fluid film can provide a protective fluid barrier for the first major surface 117 and or the second major surface 119 from particles (e.g., relatively large particle species and/or relatively small particle species) generated during the machining process.

In a horizontal orientation, it is possible to provide one or both of the first major surface 117 and/or second major surface 119 with one or more fluid dispensing devices. For example, as shown in FIG. 1, any of the upstream working device(s) 101*a*, 101*b* and the downstream working device 101*c* may include a fluid dispensing device 103 that may be used to generate a laminar flow 107 of a fluid film 109 coat the first surface 117, that may comprise the upper surface of the glass sheet in the orientation shown in FIG. 1. The fluid film may be dispensed as a planar sheet of fluid film 109 designed to coat the first surface 117 of the glass sheet 111.

Figure 2:
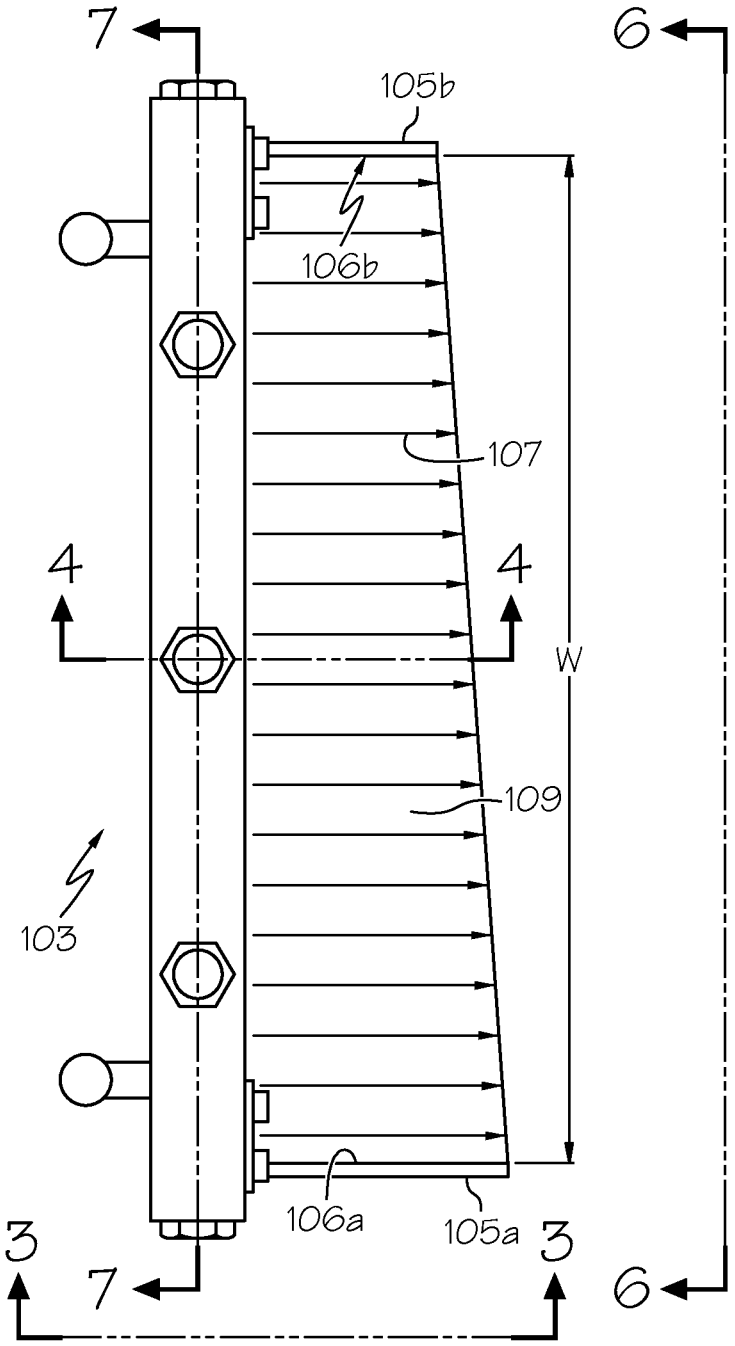
FIG. 2 is a top view of an example fluid dispensing device of the glass treatment apparatus of FIG. 1.

FIGS. 2-8 illustrate example features of one fluid dispensing device 103 that may be optionally used to protect the first surface 117 of the glass sheet 111 although a similar or identical construction may be used to protect the second surface 119 of the glass sheet in further examples. FIG. 2 illustrates a top view of the fluid dispensing device 103 with a fluid film 109 being dispensed for illustration purposes. As shown, the fluid film 109 can have a width "W" transverse to the laminar flow 107 that extends between a first flow expander 105*a* and a second flow expander 105*b*. As shown, the first and second flow expanders 105*a*, 105*b* can each include a corresponding expanding surface 106*a*, 106*b* that face one another. As shown, the expanding surfaces 106*a*, 106*b* can be substantially planar and may also extend substantially parallel to one another. With such a configuration, the flow expanders 105*a*, 105*b* can help maintain the fluid film 109 with a substantially constant width "W" as the fluid film is deposited to coat the first surface 117 of the glass sheet 111. Although not shown, the expanding surfaces 106*a*, 106*b* may converge or diverge from one another in further examples to control the final width of the fluid film 109 being deposited on the first surface of the glass sheet 111.

The flow expanders 105*a*, 105*b*, if provided, can operate to expand the width of the fluid film 109 that is being deposited to coat the first surface 117. Indeed, without flow expanders, the surface tension of the fluid, such as water, would naturally tend to cause a converging flow of the fluid film 109 as the fluid film travels away from the elongated opening of the fluid dispensing device 103. By contacting the outer edges of the fluid film 109 with the expanding surfaces 106*a*, 106*b*, the fluid film is expanded from the natural tendency of the fluid film to converge as it travels away from the elongated opening. If the fluid film were allowed to converge uncontrolled, a substantially turbulent flow may eventually be produced when introducing the fluid film to coat the surface 117 of the glass sheet. As such, the flow expanders 105*a*, 105*b* may be provided to help maintain the laminar flow 107 of the fluid film 109 as it is placed on the surface 117 of the glass sheet.

Figure 3:
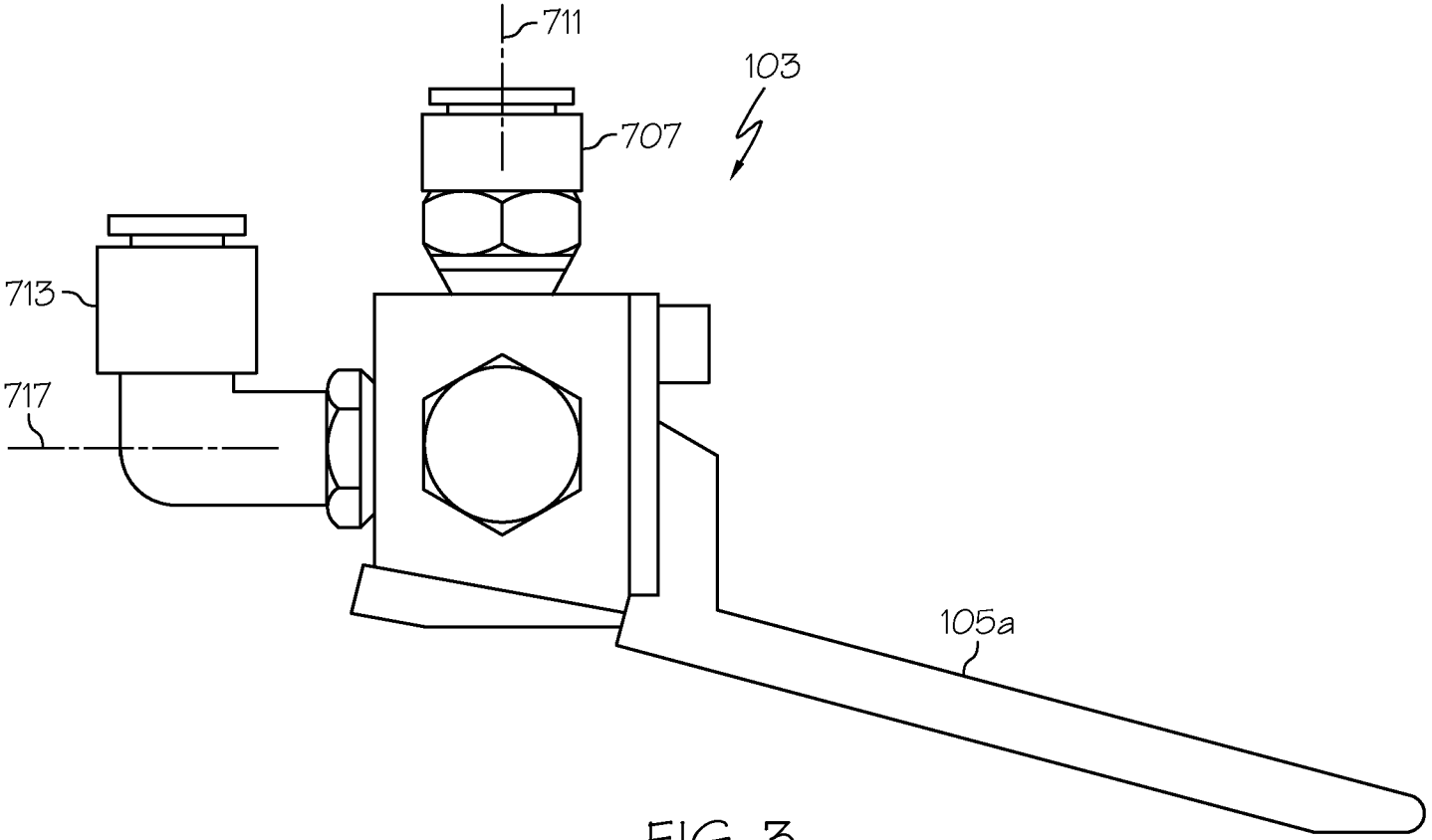
FIG. 3 is an end view of the fluid dispensing device along line 3-3 of FIG. 2.
Figure 4:
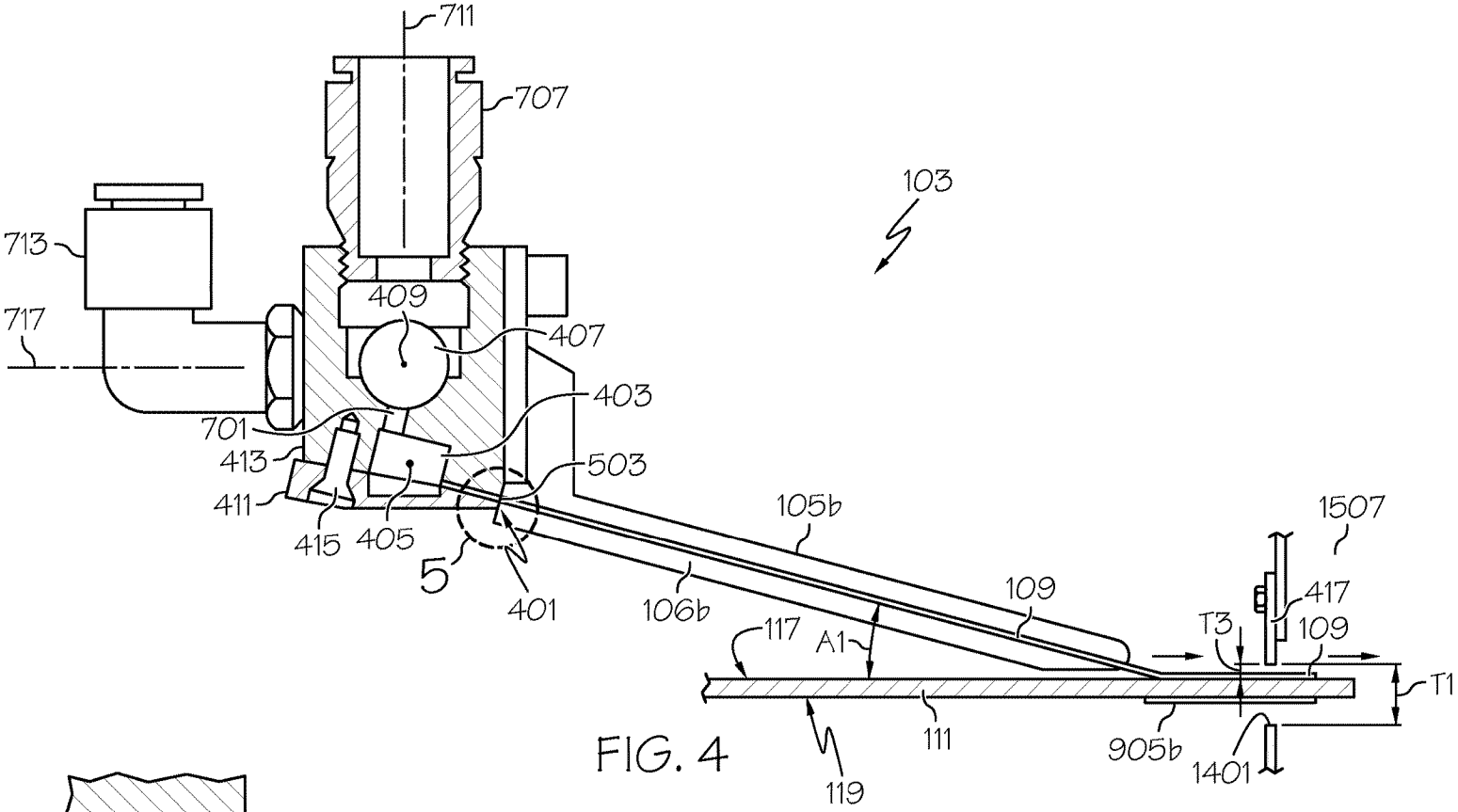
FIG. 4 is a cross sectional view of the fluid dispensing device along line 4-4 of FIG. 2.

As shown in FIGS. 2-4, the first and second flow expander 105*a*, 105*b* may be substantially identical or similar to one another. In the illustrated example, the first flow expander 105*a* may be longer than the second flow expander 105*b* although the flow expanders may have substantially identical lengths in further examples. As further shown in FIGS. 4 and 5, the fluid dispensing device 103 includes a dispensing surface 401 facing a dispensing direction 501. As shown in FIG. 6, the first dispensing surface 401 defines an elongated opening 503 that is elongated to define the width "W" of the fluid film 109. Although not necessarily to scale, as shown in FIG. 5, the elongated opening 503 can include a thickness "t" within a range of from about 50 microns to about 1 mm, for example, from about 100 microns to about 500 microns, for example, from about 200 microns to about 300 microns, for example, about 250 microns.

Figure 5:
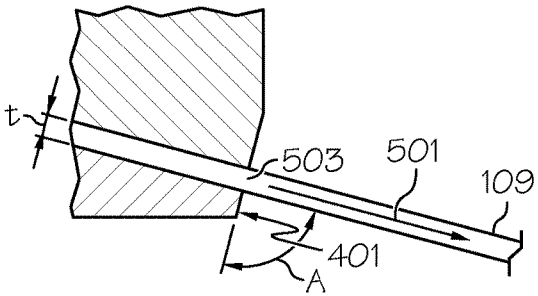
FIG. 5 is an enlarged view of portions of the fluid dispensing device of FIG. 4.
Figure 6:
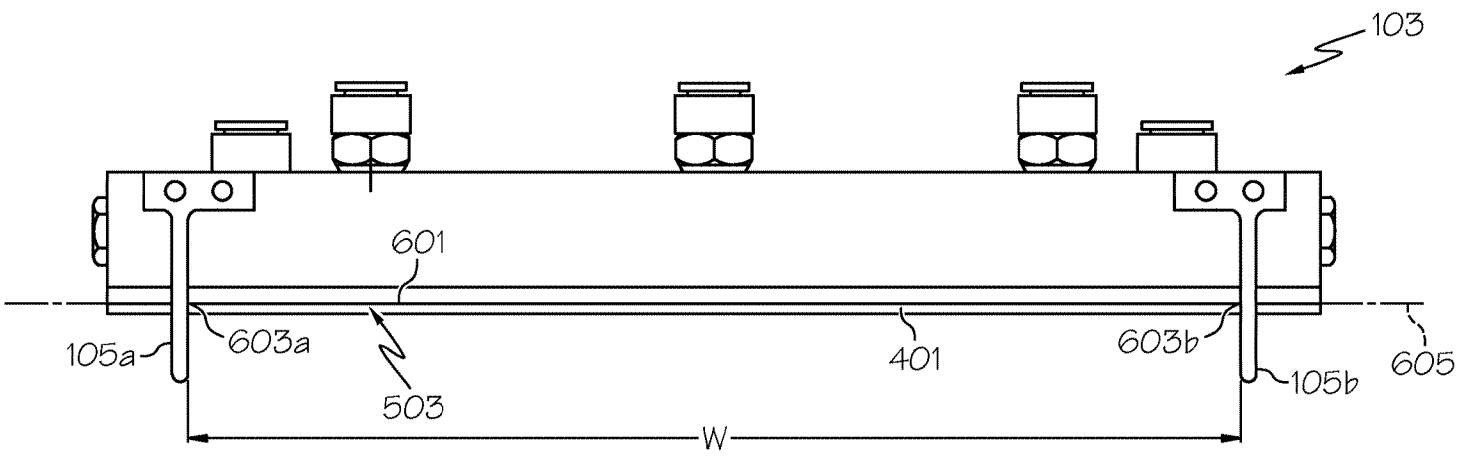
FIG. 6 is a front view of the fluid dispensing device along line 6-6 of FIG. 2.

As further shown in FIG. 5, in one example, the fluid dispensing device 103 can be configured to dispense the laminar fluid film 109 such that the dispensing direction 501 at an angle "A" that can be substantially 90° relative to the dispensing surface 401. Providing the dispensing direction 501 of the fluid film 109 in a substantially perpendicular orientation with respect to the dispensing surface 401 can help prevent the fluid film 109 exiting from the elongated opening 503 from wrapping backwards and thereby creating a turbulent flow. As such, dispensing the laminar fluid film 109 such that the dispensing direction at an angle "A" that is substantially perpendicular to the dispensing surface 401 can help maintain the laminar flow 107 of the fluid film 109.

As shown in FIG. 6, the dispensing surface 401 defines the elongated opening 503 with an elongated central portion 601 extending along an elongated axis 605 between first and second opposed end portions 603*a*, 603*b*. The first opposed end portion 603*a* can be provided with the first flow expander 105*a* extending from the dispensing surface 401 in the dispensing direction 501 and the second opposed end portion 603*b* can be provided with the second flow expander 105*b* extending from the dispensing surface 401 in the dispensing direction 501. As previously discussed, the width "W" of the fluid film 109 can thereby be defined by the elongated opening 503 with the optional flow expanders 105*a*, 105*b*.

Various structures may be designed to deliver fluid, such as water, through the elongated opening 503 to achieve the fluid film 109 in laminar flow 107. For example, the fluid dispensing device 103 can include a first elongated chamber 403 having a first chamber axis 405 extending along an elongated axis 605 of the elongated opening 503, wherein the first elongated chamber 403 is in fluid communication with the elongated opening 503. The first elongated chamber 403, if provided, may be formed by a single portion or defined by a plurality of portions fastened together. For example, as shown in FIG. 4, the first elongated chamber 403 may be formed by fastening a second portion 411 to a first portion 413 with fasteners 415. In further examples, the fluid dispensing device 103 can include an optional second elongated chamber 407 including a second chamber axis 409 substantially parallel to the first chamber axis 405. In such examples, the second elongated chamber 407 can be placed in fluid communication with the first elongated chamber 403 and the first elongated chamber 403 can be positioned along a flow path between the elongated opening 503 and the second elongated chamber 407. As such, the first elongated chamber 403 can be positioned downstream from the second elongated chamber 407 and the elongated opening 503 can be positioned downstream from the first and second elongated chambers 403, 407. In one example, as shown in FIG. 6, fluid communication between the first and second elongated chambers 403, 407 may be provided by a plurality of apertures 701 extending through an elongated partition wall 703 extending between the elongated chambers.

As shown, the first chamber axis 405 can be oriented substantially parallel to the elongated opening 503 and the second chamber axis 409 can extend substantially parallel to the first chamber axis 405 and the elongated opening 503. Providing the second elongated chamber 407 along the first elongated chamber 405 can further facilitate control pressure distribution and fluid flow along the length of the elongated opening 503, thereby further helping provide an even flow that facilitates maintenance of an even and laminar flow 107 of fluid film 109 through the elongated opening 503.

Figure 7:
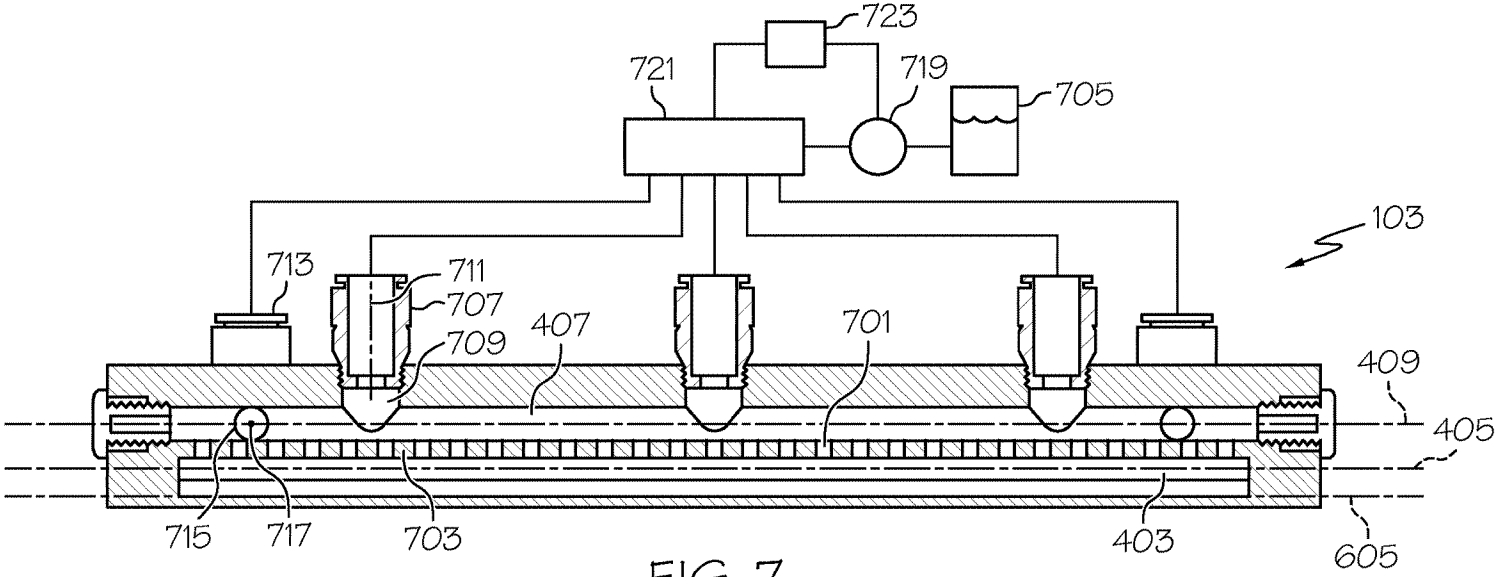
FIG. 7 is a cross sectional view of the fluid dispensing device along line 7-7 of FIG. 2.

As shown in FIG. 7, a fluid source 705, such as a container of water, may be placed in fluid communication with one or more first ports 707 configured to introduce fluid through an opening 709 into the second elongated chamber 407 along an axis 711 that may be perpendicular to the second chamber axis 409. In addition or alternatively, the fluid source 705 may be placed in fluid communication with one or more second ports 713 configured to introduce fluid through an opening 715 into the second elongated chamber 407 along an axis 717 that may also be perpendicular to the second chamber axis 409 and/or each elongated axis 711 of the first fluid port 707. Providing multiple entry points for the fluid can help facilitate maintenance of an even and laminar flow 107 of fluid film 109 through the elongated opening 503. In one example, a pump 719 may provide fluid to a manifold 721 that may distribute the fluid to the first and second ports 707, 713 in a manner that best achieves uniform laminar flow in the fluid film. A computer 723 may control fluid flow through the ports by operating valves in the manifold and/or controlling operation of the pump 719.

Figure 9:
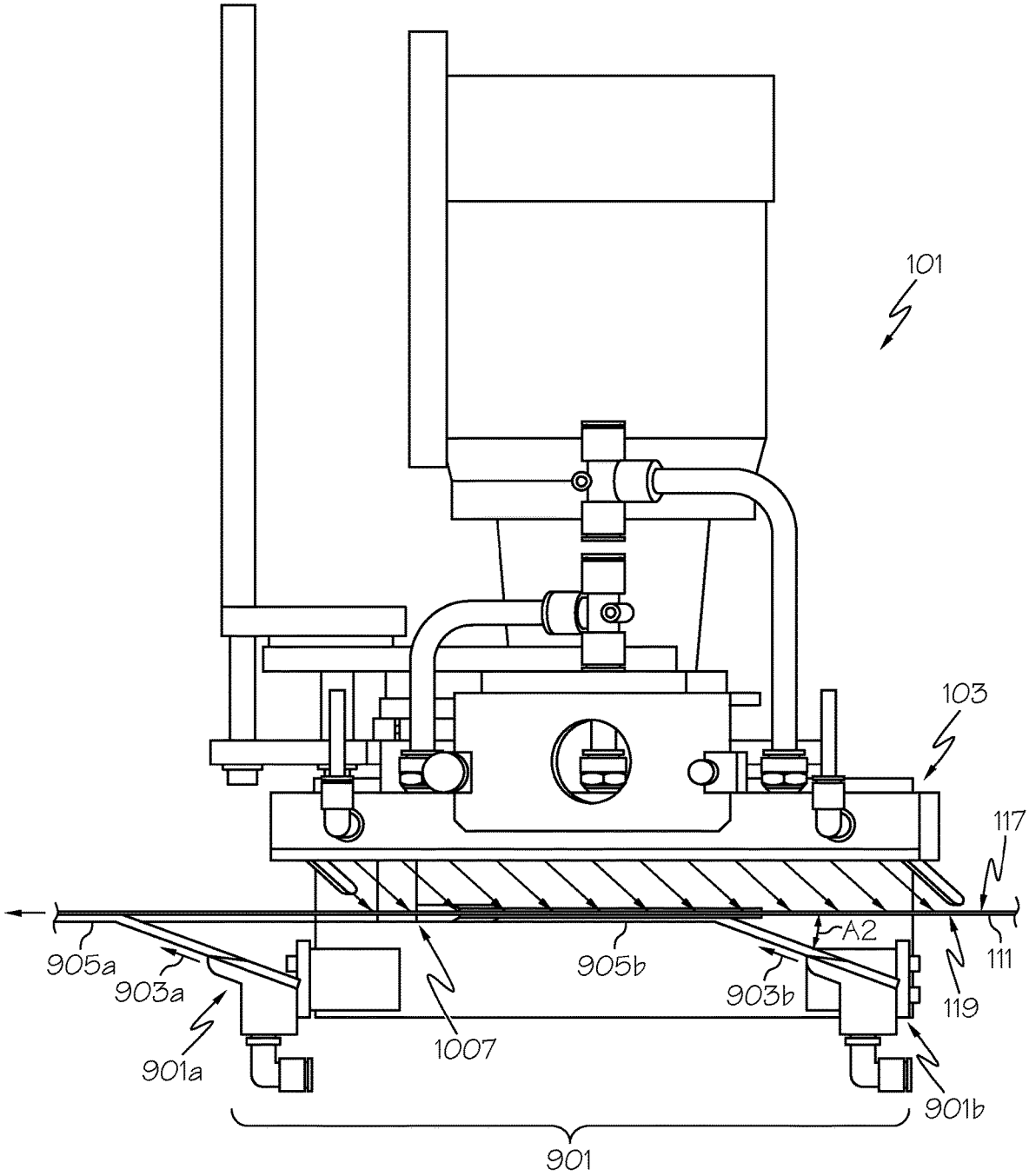
FIG. 9 is a front view of the illustrative working device of the fluid dispensing apparatus of FIG. 1.

FIGS. 9-13 disclose another example fluid dispensing device 901 that may be incorporated in any one of the upstream working device(s) 101*a*, 101*b* and/or the downstream working device 101*c* of the glass treatment apparatus 101. As shown in FIGS. 9 and 10, the fluid dispensing device can include a first dispensing device 901*a* and a second dispensing device 901*b* although a single dispensing device or more than two dispensing devices may be used in further examples. Moreover, as shown, the fluid dispensing devices 901*a*, 901*b* may be identical to one another although alternative constructions may be provided in further examples. The fluid dispensing devices 901*a*, 901*b* can be configured to dispense a substantially laminar flow 903*a*, 903*b* of a fluid film 905*a*, 905*b* from an elongated opening in a dispensing direction of the fluid dispensing device.

The fluid dispensing devices 901*a*, 901*b* can be designed to coat the second surface 119 with the substantially laminar flow 903*a*, 903*b* of the fluid film 905*a*, 905*b*. In the illustrated orientation, the second surface 119 can comprise the lower surface of the glass sheet 111. As such, the fluid dispensing devices 901*a*, 901*b* may provide a relatively reduce width fluid film when compared to the fluid film 109 associated with the fluid dispensing device 103 discussed above. As such, the flow expanders may not be necessary for the fluid dispensing devices illustrated in FIGS. 11 and 12.

Figure 11:
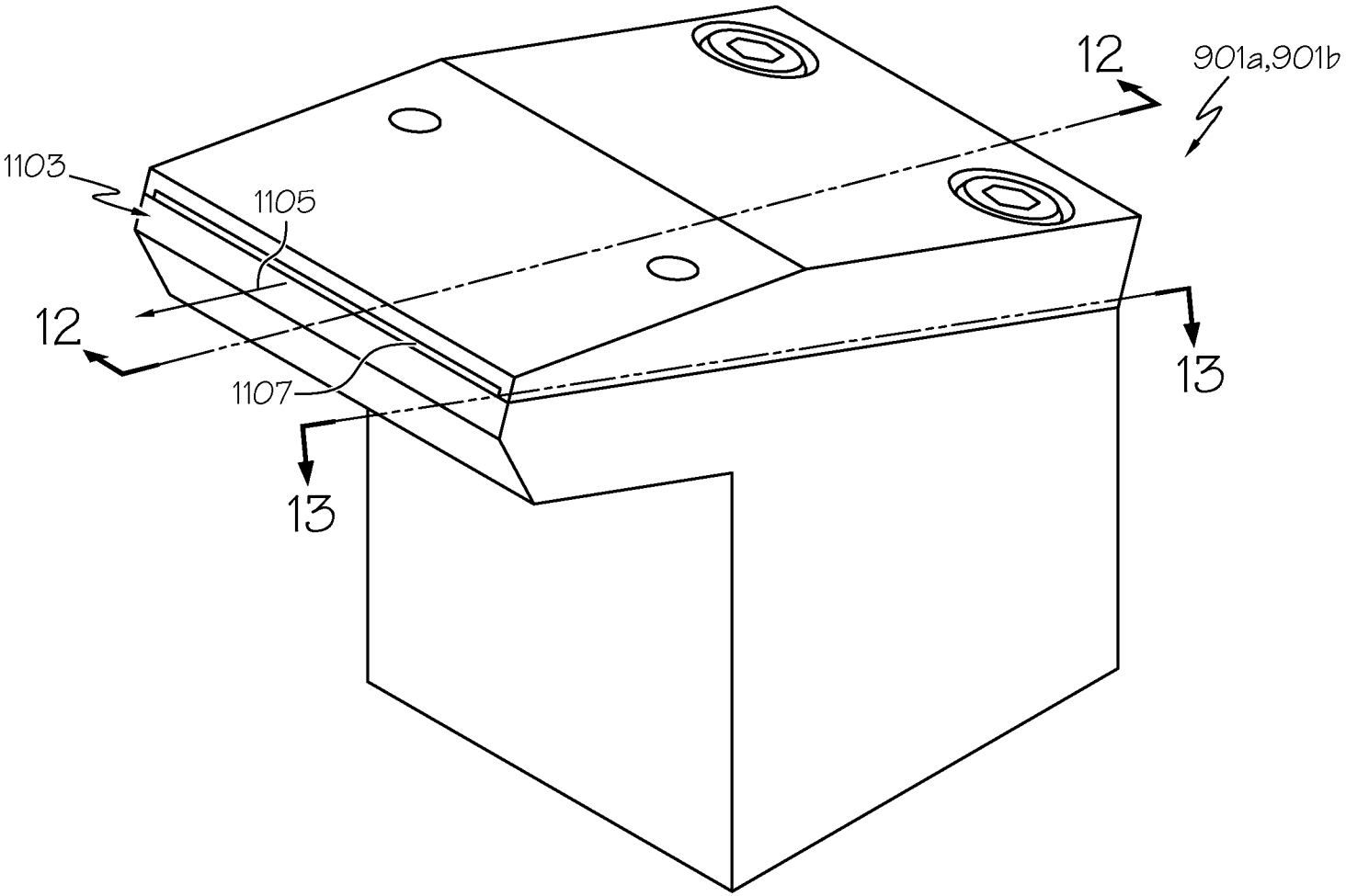
FIG. 11 is a perspective view of an example of another fluid dispensing device of the glass treatment apparatus of FIG. 1.
Figure 12:
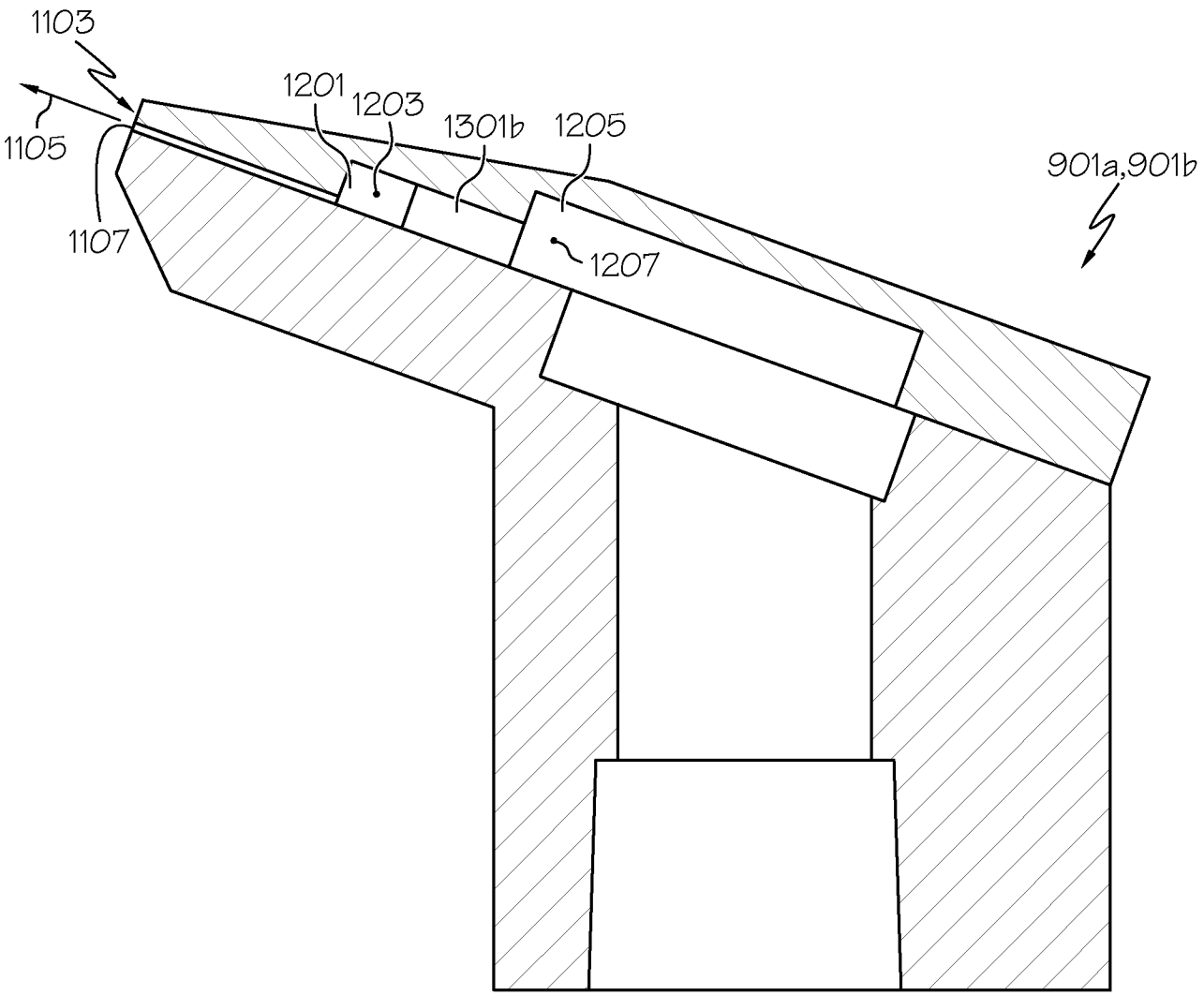
FIG. 12 is a cross sectional view of the fluid dispensing device along line 12-12 of FIG. 11.
Figure 13:
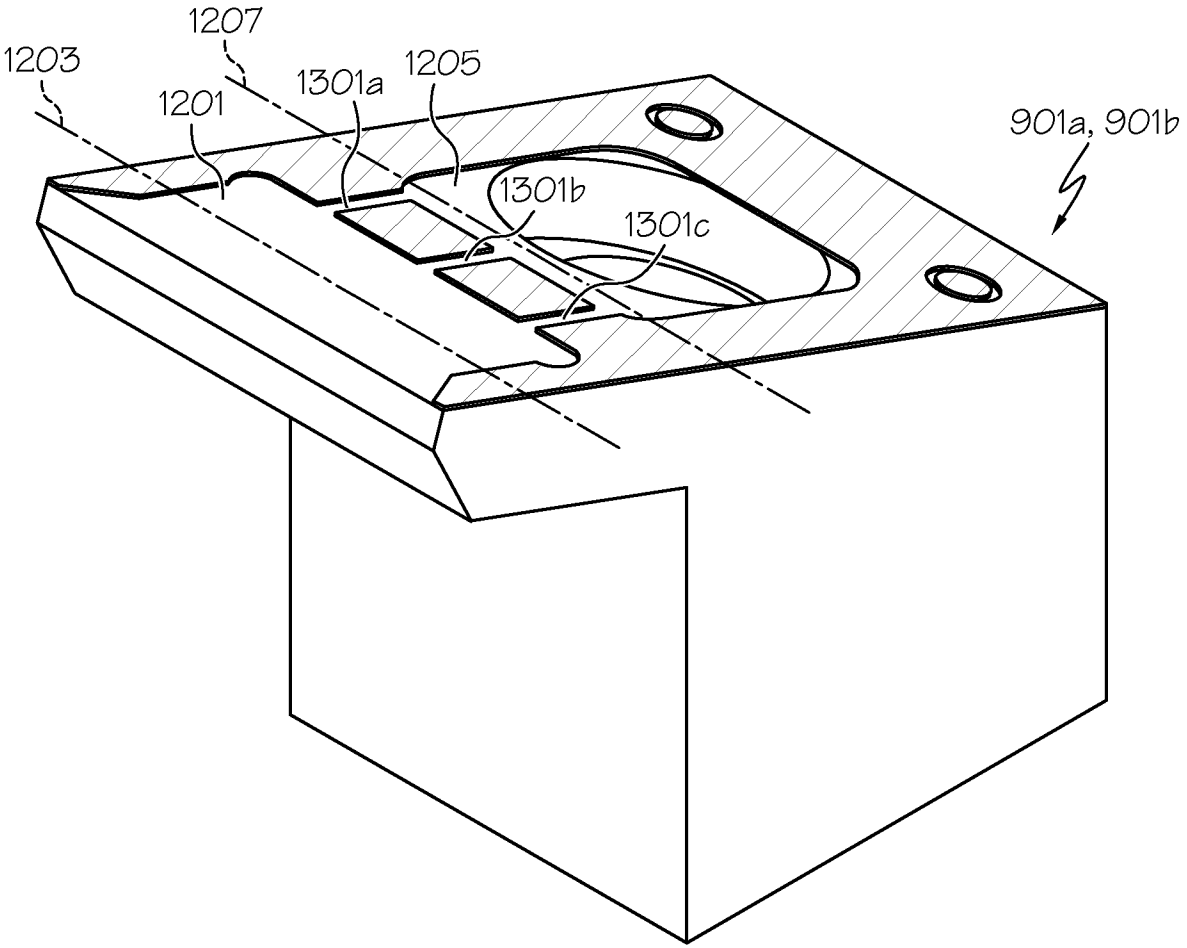
FIG. 13 is a cross sectional view of the fluid dispensing device along line 13-13 of FIG. 11.

As shown in FIGS. 11 and 12, the fluid dispensing devices 901*a*, 901*b* can include a dispensing surface 1103 facing a dispensing direction 1105, wherein the dispensing surface 1103 defines an elongated opening 1107. As shown in FIG. 12, the fluid dispensing devices 901*a*, 901*b* each further includes a first elongated chamber 1201 in fluid communication with the elongated opening 1107. The first elongated chamber 1201 can include a first chamber axis 1203 extending substantially parallel to the elongated opening 1107. In another example, the fluid dispensing devices 901*a*, 901*b* each further includes a second chamber 1205 in fluid communication with the first elongated chamber 1201. Although not necessary, as shown, the second chamber 1205 may be elongated along a second chamber axis 1207 extending substantially parallel to the first chamber axis 1203 and the elongated opening 1107. Moreover, as shown in FIG. 13, a plurality of apertures 1301*a*, 1301*b*, 1301*c* may provide fluid communication between the first elongated chamber 1201 and the second chamber 1205. Providing separate chambers with the apertures can help facilitate maintenance of a substantially laminar flow fluid film through the elongated opening 1107.

Further referring to back to FIG. 10, as mentioned previously, each of the upstream working device(s) 101*a*, 101*b* and the downstream working device 101*c* includes the working wheel 1001 configured to rotate in a direction 1104 about a rotation axis 1102 such that an outer peripheral surface 1003 of the working wheel 1001 machines (i.e., grinds, polishes and/or cleans) a surface, such as the outer peripheral edge 113, of a glass sheet 111. The glass treatment apparatus can also include the previously-mentioned shroud 1005 substantially circumscribing the outer peripheral surface 1003 of the working wheel 1001. In the illustrated example, the shroud 1005 can be open in the Z direction illustrated in FIG. 1 such that gravity may draw fluid, particles and/or other contaminants downward in the Z direction. The shroud 1005 can be designed to shield the pristine surfaces 117, 119 of the glass sheet 111 from particles and/or other contaminants associated with the machining process during grinding and/or polishing procedures associated with the upstream working device(s) 101*a*, 101*b*. As further illustrated in FIG. 1, the downstream working device 101*c* can also include the shroud 1005 that can be designed to shield the pristine surfaces 117, 119 of the glass sheet 111 from particles and/or other contaminants cleaned from the surface portion of the glass sheet 111.

Figure 14:
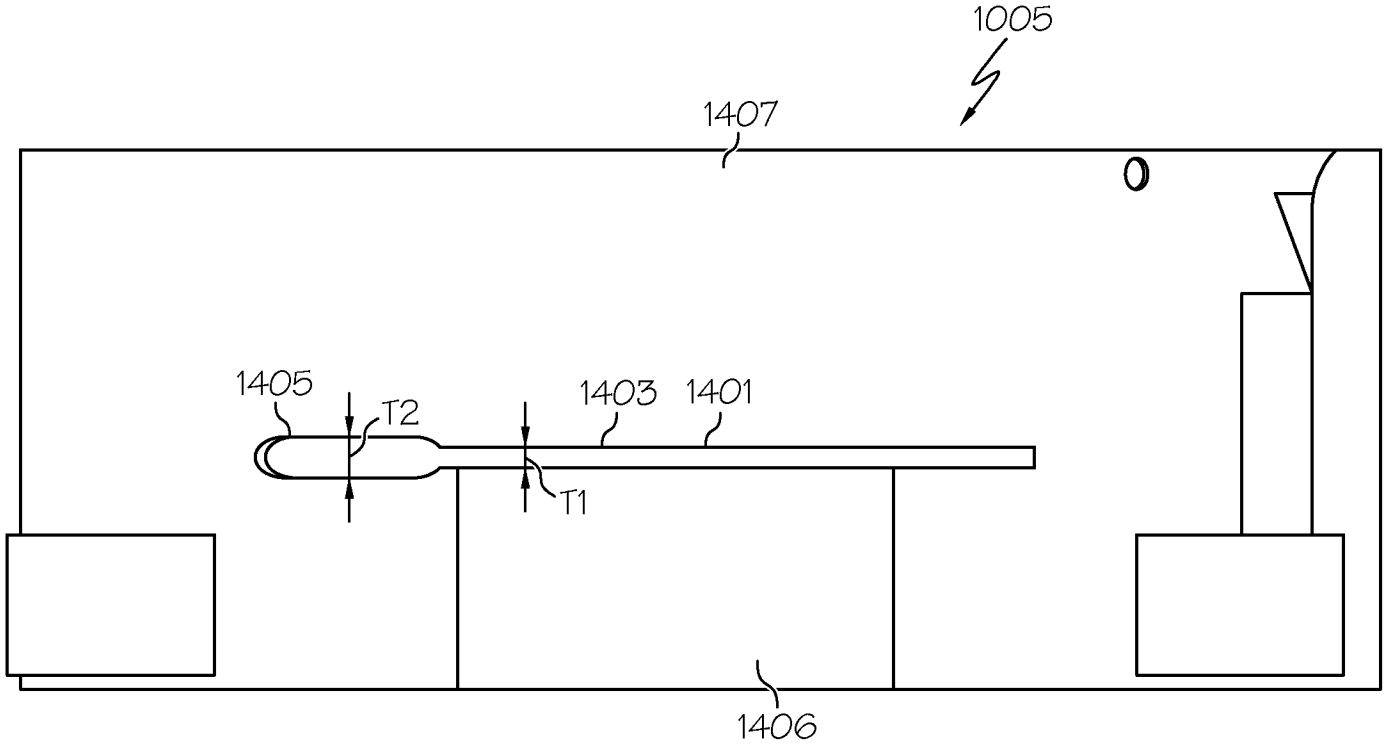
FIG. 14 is a front view of an example shroud of the glass treatment device of FIG. 1.

As shown in FIG. 14, if provided, the shroud 1005 can be provided with a slot 1401 configured to receive the edge portion 115 of the glass sheet 111. The slot includes a first segment 1403 having a thickness T1 sufficient to accommodate the edge portion of the glass sheet. The slot 1401 can further include an optional second portion 1405 that may have an enlarged thickness T2 designed to accommodate a fluid nozzle 1007 (see FIGS. 9 and 10) designed to introduce cooling and/or working fluid to the working interface 1015 of the outer peripheral surface 1003 of the working wheel 1001 and the surface of the glass sheet 111. The shroud 1005 may include a recessed inner portion, such as the illustrated planar portion 1406 below the slot 1401 to allow clearance for the fluid film generated by the first and second fluid dispensing devices 901*a*, 901*b*.

Figure 15:
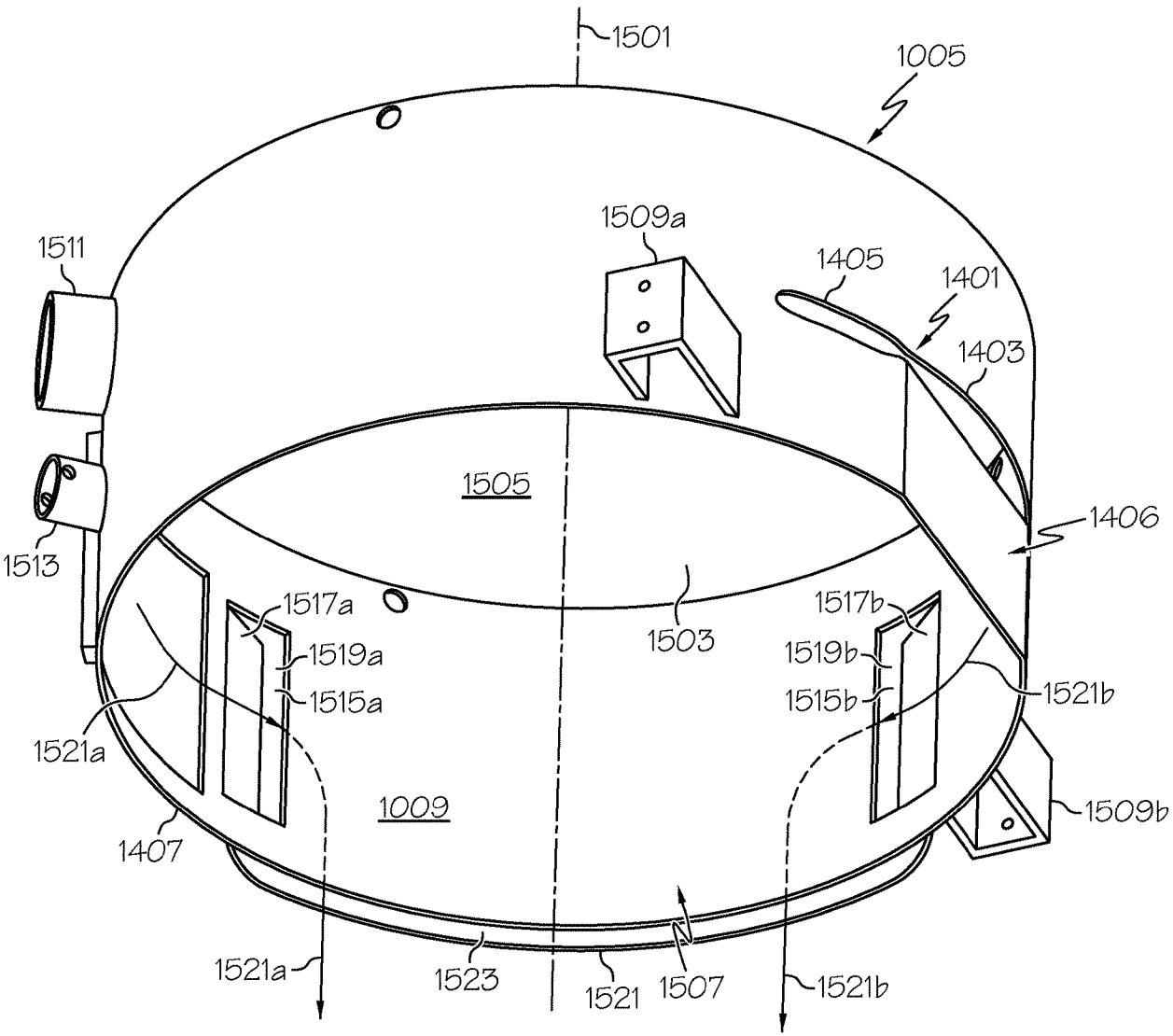
FIG. 15 is a lower perspective view of the shroud of FIG. 14.

As shown in FIG. 14, the shroud 1005 can include an outer cylindrical peripheral wall 1407. As shown in FIG. 15, in some examples, the outer cylindrical wall 1407 can comprise a circular cylindrical wall disposed about a central axis 1501 of the shroud 1005. As shown in FIG. 10, the shroud 1005 can be mounted relative to the working wheel 1001 such that the central axis 1501 of the shroud 1005 is coincident with the rotation axis 1102 of the working wheel 1001. As shown in FIG. 10, a gap "G" can thereby be maintained between the outer peripheral surface 1003 of the working wheel 1001 and the inner surface 1009 of the shroud 1005. A sufficient gap can be provided to allow movement of fluid along the inner surface 1009 of the outer cylindrical peripheral wall 1407 without substantial interference with the outer peripheral surface 1003 of the working wheel 1101 that may be rotating within a range of 3600-8000 rpm. In one example, the gap "G" may be within a range of from about 5 mm to about 15 mm although the gap may be smaller or larger in further examples.

Turning back to FIG. 15, the shroud 1005 further includes a top wall 1503 with an inner surface 1505 cooperating with the inner surface 1009 of the outer cylindrical peripheral wall 1407 to define a containment area 1507. The containment area 1507 can include an open lower portion and an upper portion that is closed by the top wall 1503. The shroud 1005 can further include one or more brackets 1509*a*, 1509*b* configured to provide a mounting location for the fluid dispensing devices 901*a*, 901*b*. Still further, the shroud may be provided with a gas port 1511 and or a wheel cleaning port 1513.

As shown in FIG. 10, the gas port 1511 can be provided with a gas nozzle 1017 configured to remove liquid from a portion of the inner surface 1009 of the shroud 1005. The gas port 1511 can therefore provide an air barrier to prevent the liquid from cycling around the inner surface 1009 of the shroud 1005.

As further shown in FIG. 10, the glass treatment apparatus 101 can comprise a fluid source 1011 acting through the wheel cleaning port 1513 and configured to direct a fluid stream 1013 to impact the outer peripheral surface 1003 of the working wheel 1001 to clean the working wheel 1001 from glass particles generated or associated with machining the surface of the glass sheet 111.

As further illustrated in FIG. 15, the outer cylindrical peripheral wall 1407 can be provided with one or more exit ports to allow removal of liquid traveling along the inner surface 1009. For example, as shown in FIG. 15, the shroud includes a first exit port 1515*a* and a second exit port 1515*b* formed by bending away corresponding first and second flaps 1517*a*, 1517*b* to form corresponding first and second openings 1519*a*, 1519*b*, such as the illustrated window openings extending through the outer cylindrical peripheral wall 1407. The first exit port 1515*a* can allow a stream of fluid traveling along a first direction indicated by arrow 1521*a* fall down along the first flap 1517*a* and into the first opening 1519*a* for subsequent removal from the containment area 1507 of the shroud 1005 as discussed more fully below. Likewise, second exit port 1515*b* can allow another stream of fluid traveling in an opposite direction indicated by arrow 1521*b* fall down along the second flap 1517*b* and into the second opening 1519*b* for subsequent removal from the containment area 1507 of the shroud 1005 as also discussed more fully below.

Figure 16:
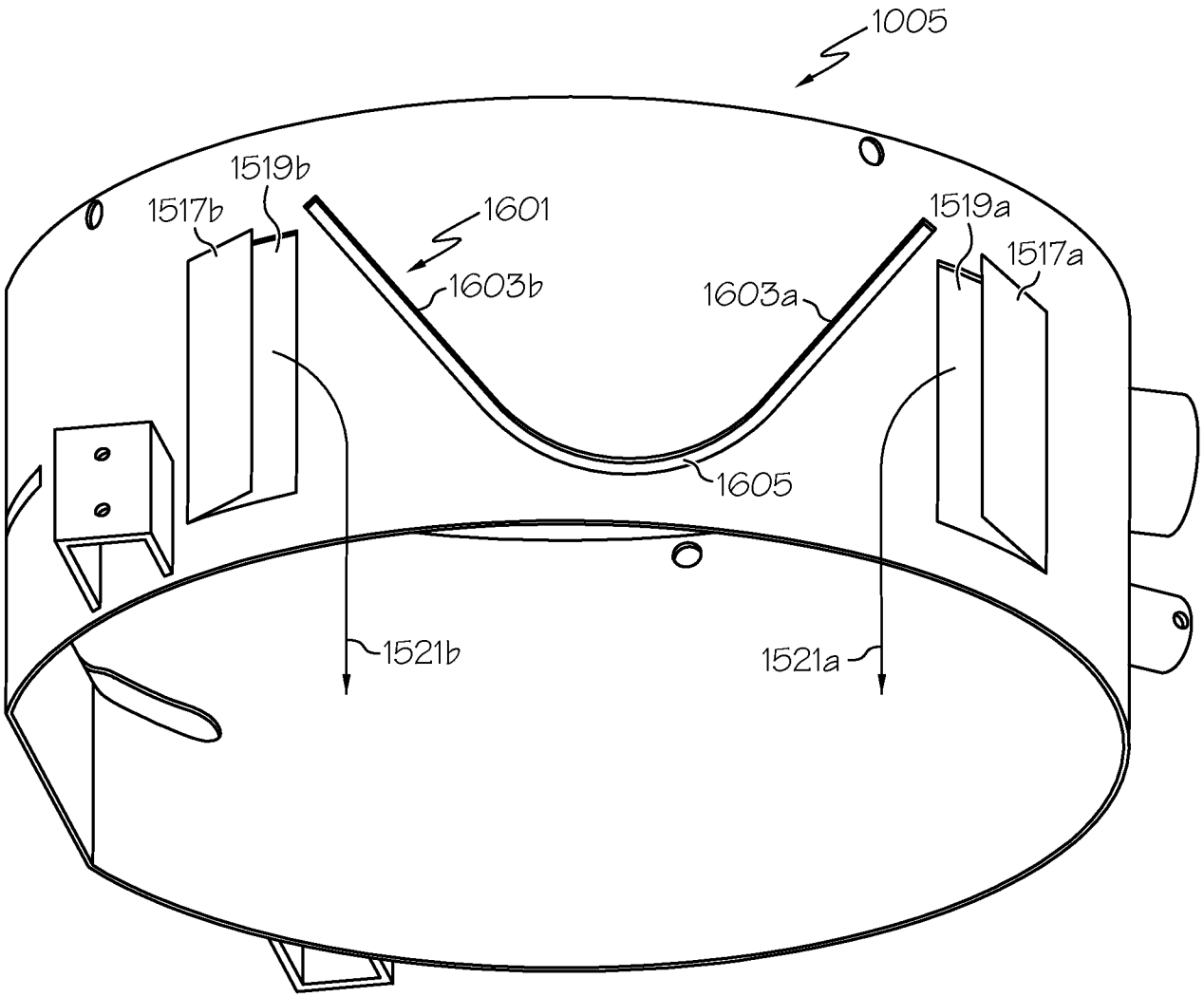
FIG. 16 is another lower perspective view of the shroud of FIG. 14.

As shown in FIGS. 10 and 15, the shroud 1005 can also include an outer wall portion 1521 configured to facilitate dispensing of liquid and particles exiting the first and second openings 1519*a*, 1519*b* to travel down along an outside surface portion of the shroud and out a lower opening 1523 defined between the outer wall portion 1521 and the outer surface portion of the shroud 1005. FIG. 16 illustrates another perspective view of the shroud 1005 with the outer wall portion 1521 removed for clarity. As shown, the shroud 1005 can include a fluid flow guide 1601 that can include a first downwardly inclined guide wall 1603*a* configured to deflect the fluid exiting the first opening 1519*a* in a downward direction. Likewise, the fluid flow guide 1601 can include a second downwardly inclined guide wall 1603*b* configured to deflect the fluid exiting the second opening 1519*b* in a downward direction. Although not necessary, the guide walls may be connected together by a lower apex portion 1605 to facilitate final exiting of the fluid through the lower opening 1523 and/or to facilitate the manufacturing process.

Turning back to FIG. 1, methods of treating glass can include dispensing the substantially laminar flow 107 of the fluid film 109 along a fluid plane to subsequently land on a first side 117 of a glass sheet 111 as shown in FIG. 4. In one example, the method can include the step of expanding the fluid film 109 with a pair of flow expanders 105*a*, 105*b* disposed on each side of the fluid film 109. In such examples, the flow expanders can help expand the fluid film 109 to maintain the laminar flow as the film travels to land on the first surface 117 of the glass sheet 111. Still further, the method can include the step of controlling fluid flow characteristics of the fluid film along the width "W" of the fluid film by controlling the pressure profile across the elongated opening 503 and the velocity profile of the fluid traveling through the elongated opening 503. For example, the pressure profile and/or velocity profile can be controlled by providing at least one of the first elongated chamber 403, the second elongated chamber 407, the apertures 701 and/or the ports 707, 713.

It can also be desired to maintain the laminar flow of the fluid film as the fluid film 109 contacts and thereafter travels along the first side 117 of the glass sheet 111. As shown in FIG. 4, one way of accomplishing a smooth continuous transition is to reduce the angle between the fluid plane and the glass sheet 111. As shown, the fluid dispensing device 103 can be arranged such that an angle "A1" of the fluid plane relative to the planar surface 117 of the glass sheet 111 is within a range of from 0° to about 30°, such as from about 5° to about 30°, such as from about 10° to about 30°.

As shown in FIGS. 9 and 10, methods of treating glass can also include the step of dispensing the substantially laminar flow 903*a*, 903*b* of the second fluid film 905*a*, 905*b* along a second fluid plane to subsequently contact the second surface 119 of the glass sheet 111. The angle of contact "A2" can be within a range of from 0° to about 30°, such as from about 5° to about 30°, such as from about 10° to about 30°. While other angles can be used in further examples, providing the angle "A1" and/or the angle "A2" within the above-referenced ranges can help maintain an organized fluid flow at the glass-water transition as the fluid film lands on the respective surface of the glass sheet.

Methods of treating the glass can also include machining the edge, such as the outer peripheral edge 113, of the glass sheet 111, wherein machined particles of the glass are entrained in the fluid film and carried away from the glass sheet. For example, as shown in FIG. 10, the working wheel 1001 may be rotated in the direction 1104 about the rotation axis 1102 such that the outer peripheral surface 1003 contacts the edge portion 115 of the glass sheet 111. In one example, the glass sheet 111 can be moved relative to the working wheel 1001 along direction 1019 while the wheel rotates along the clockwise direction 1104 shown in FIG. 10. As such, the working area of the outer peripheral surface 1003 travels in a direction 1021 opposite to the direction 1019 that the glass moves relative to the working wheel 1001. Relative movement between the glass sheet 111 and the glass treatment apparatus 101 can be provided by moving the glass treatment apparatus 101 relative to the glass sheet 111 and/or the glass sheet 111 relative to the glass treatment apparatus 101. The working wheel 1001 can comprise a grinding wheel with diamond particles or other materials sufficient to work (such as grind, polish or otherwise finish) the edge of the glass sheet.

The fluid nozzle 1007 can provide cooling fluid 1008 at the working interface 1015. In one example, the fluid nozzle 1007 extends through an enlarged section 1405 (see FIG. 14) of the slot 1401. The cooling fluid 1008 can then be directed to the working interface 1015 to reduce heat that may otherwise damage the glass sheet 111. The coolant fluid can be directed generally in the direction 1021 of the working portion of the working wheel 1001. Excess cooling fluid 1008 and any particles entrained therein can then be moved away, for example, by the laminar flow of the fluid films 109, 905*b* from the fluid dispensing devices 103, 901. The cooling fluid 1008 can eventually exit, for example, by passing down through the bottom of the shroud and/or through one of the exit ports in the outer cylindrical peripheral wall 1407.

Particles of glass and/or particles of the grinding wheel may be released during the grinding process. Various example techniques are designed to protect the pristine surfaces 117, 119 of the glass sheet 111 from these particles. As shown in FIGS. 1 and 4, the laminar flow 107 of the fluid film 109 can travel along the first surface 117 in a direction toward the grinding zone. As shown in FIG. 4, the fluid film 109 can freely travel through an upper area of the slot 1401 having a thickness "T3" sufficient to allow uninterrupted passage of the laminar fluid film into the containment area 1507. In one example, "T3" can be about 350 microns although other thicknesses may be used in further examples. Furthermore, the slot clearance underneath the glass sheet may be sufficient, such as similar or identical to T3" for the fluid film 905*b*. As shown, the overall slot thickness "T1" can be adjusted by an optional shutter 417 depending on the processing parameters of the particular application. In some examples, "T1" may be provided or adjusted to be about 1 mm to about 3 mm although other thicknesses may be used in further examples.

Figure 8:
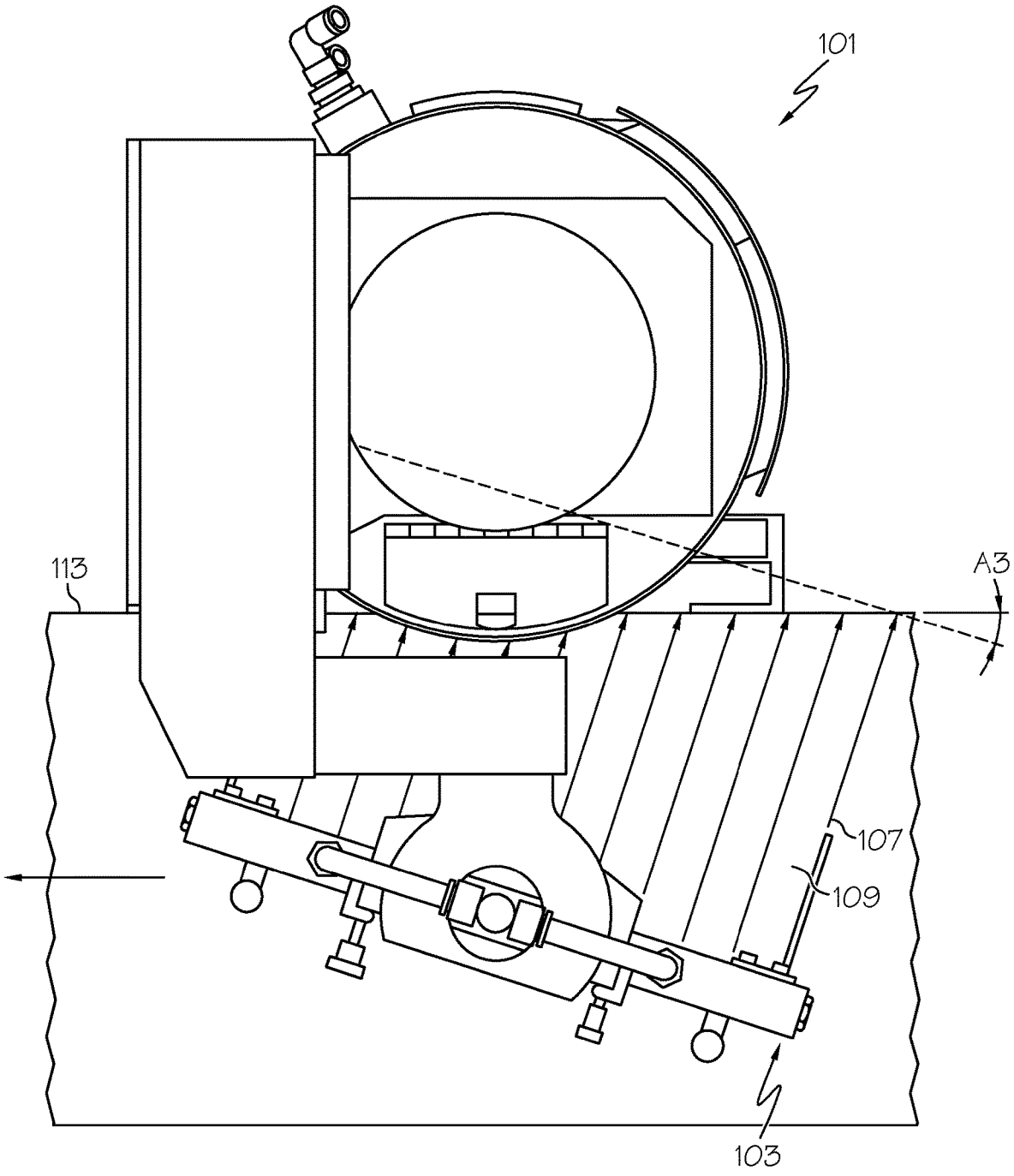
FIG. 8 is a top view of an illustrative working device of the fluid dispensing apparatus of FIG. 1.

As shown in FIG. 8, a dashed line is shown for illustrative purposes as a line that is parallel to the elongated opening 503 and extends through the fluid plane of the laminar flow 107 of the fluid film 109. The dashed line is also positioned to intersect the edge 113 of the glass sheet 111 at a point where the right side of the fluid film 109, as viewed from the top in FIG. 8, passes over the edge 113 of the glass sheet 111. As such, it will be understood that the laminar flow lines 107 shown in FIG. 8 are perpendicular to both the dashed line and the elongated opening 503 of the fluid dispensing device 103. As represented by the dashed line in FIG. 8, it can be desired to orient the fluid dispensing device 103 such that an angle "A3" of the fluid plane relative to the intersection of the fluid plane and the outer peripheral edge 113 is within a range of about 10° to about 30°, such as about 20°. Providing such an angled orientation can help effectively protect the pristine surfaces of the glass sheet when moving the glass sheet and the glass treatment apparatus relative to one another during a machining procedure.

The laminar fluid film 109 then freely coats the first surface 117 of the glass sheet 111 and travels within and further coats the first surface 117 of the glass sheet 111 in the vicinity of the working area. Particles within the containment area 1507 are thereby prevented from contacting the first surface 117 since any particles that would otherwise land on the first surface 117 are entrained in the fluid film 109 and carried away before the particles have a chance to interact with the first surface 117 of the glass sheet 111. Once entrained, the fluid film then leaves the surface 117 of the glass sheet 111 and can then travel down through the bottom open end of the containment area 1507. Alternatively, the fluid passes along the inner surface 1009 of the outer cylindrical peripheral wall 1407, out the second exit port 1515*b* and down through the lower opening 1523. As such, the liquid also prevents settling of particles on the inner surface 1009 of the shroud 1005, thereby preventing particle accumulation that may otherwise result in eventual contamination of the pristine surfaces of the glass sheet.

In further examples, another dispensing device, such as the first and/or second fluid dispensing devices 901*a*, 901*b*, may be used to help protect the second surface 119 of the glass sheet 111. For example, the fluid film 905*a*, 905*b* of the of the fluid dispensing devices 901*a*, 901*b* may coat the second surface 119 such that the laminar flow 903*a*, 903*b* is maintained as the fluid film travels in a direction substantially parallel to the outer peripheral edge 113 as shown in FIG. 10. Portions of the laminar flow of the fluid film 905*b* can pass through the slot 1401 and into the containment area 1507. As such, machined particles that may otherwise contact the second surface 119 are entrained into the fluid film 905*b* and carried away from the glass sheet without damaging the second surface 119 of the glass sheet 111. In one example, the fluid may travel off the glass sheet and down through the bottom open end of the containment area 1507. Alternatively, the fluid can pass along the inner surface 1009 of the outer cylindrical peripheral wall 1407, out the second exit port 1515*b* and down through the lower opening 1523. Further, if any fluid passes back out through the slot 1401, another laminar flow of film from the second fluid dispensing device 901*a* can further facilitate removal of the fluid from the lower surface of the glass sheet.

As shown in FIG. 10, methods of the disclosure can include the steps of providing each of the upstream working devices 101*a*, 101*b* and the downstream working device 101*c* with the working wheel 1001 with the outer peripheral surface 1003 and the shroud 1005 substantially circumscribing the outer peripheral surface 1003. The method includes the step of rotating the working wheel 1001 in the direction 1104 about the rotation axis 1102 and moving the glass sheet 111 relative to the glass treatment apparatus 101 such that the edge portion 115 of the glass sheet 111 passes through the slot 1401 with the outer peripheral edge 113 of the glass sheet 111 being machined by the rotating working wheel 1001. The method can further includes the step of passing fluid over an inner surface 1009 of the shroud 1005 to carry away machined particles from the glass sheet 111 generated when machining the outer peripheral edge 113 of the glass sheet 111.

In one example, fluid from one of the fluid dispensing devices 103, 901 may eventually pass over the inner surface 1009 of the shroud 1005 and thereafter carry away machined particles. As such, fluid from the fluid dispensing devices 103, 901 passing through the slot 1401 may eventually coat a portion of the inner surface 1009 to prevent particles from accumulating on the inner surface. Rather, any such particles would encounter the fluid passing over the inner surface and eventually pass down through the open bottom of the containment area 1507 and/or through the lower opening 1523.

Therefore, in one example, the method can include the step of dispensing the substantially laminar flow 107 of the fluid film 109 along a fluid plane to subsequently land on the first side 117 of a glass sheet 111 at a location outside of the shroud 1005. The method can then include the step of passing the fluid film 109 along the first side 117 of the glass sheet 111 and through the slot 1401 of the shroud 1005 as shown in FIG. 4. Machined particles of glass (i.e., generated during grinding/polishing and/or subsequently cleaned) can then be entrained in the fluid film before or after a portion of the fluid film passes over the inner surface of the shroud to carry away machined particles from the glass sheet. In one example, the method can further include the step of passing the fluid with the entrained machined particles of glass through one of the exit ports 1515*a*, 1515*b* in the shroud 1005.

In another example, the method can include the step of dispensing the substantially laminar flow 903*b* of the fluid film 905*b* along a fluid plane to subsequently land on the second side 119 of the glass sheet 111 at a location outside of the shroud 1005. The method can then include the step of passing the fluid film 905*b* along the second side 119 of the glass sheet 111 and through the slot 1401 of the shroud 1005 as shown in FIGS. 4 and 10. Machined particles of glass can then be entrained in the fluid film before or after a portion of the fluid film passes over the inner surface of the shroud to carry away machined particles from the glass sheet. In one example, the method can further include the step of passing the fluid with the entrained machined particles of glass through one of the exit ports 1515*a*, 1515*b* in the shroud 1005.

Further aspects of the disclosure can include cleaning the working wheel from glass particles accumulated when machining (i.e., grinding/polishing or cleaning) the edge of the glass sheet. Cleaning the working wheel can help manage glass particle accumulation to reduce the probability of large particle masses being spun off of the wheel that may otherwise contaminate the pristine surfaces of the glass sheet. As shown in FIG. 10, such methods can include the step of impacting the outer peripheral surface 1003 of the working wheel 1001 with a fluid stream 1013 to clean the working wheel 1001 from glass particles accumulated when machining the edge of the glass sheet.

As shown in FIG. 10, the fluid stream 1013 impacts the outer peripheral surface 1003 of the working wheel 1001 at an acute angle "A4" relative to a first axis 1525 that is perpendicular to a second axis 1527 that is tangent to the point of impact 1529. As shown, the angle "A4" can be a positive value wherein it is tilted in the direction of the rotation of the working wheel 1001 or a negative value where it is tilted in away from the direction of the rotation of the working wheel 1001. In one example, "A4" can be 30° in the positive or negative direction as shown in FIG. 10. Other angles may be provided in further examples. Still further, the fluid stream 1013 may be in the direction of the first axis 1525 in still further examples.

As shown in FIGS. 10 and 15, orienting the stream in the positive 30° orientation can help direct fluid toward the first exit port 1515*a* associated with the first flap 1517*a*. As such, fluid including particles therein may be directed to exit the first exit port 1515*a* and or pass down through the bottom opening of the containment area 1507.

In still further examples, the method can include the step of providing an air barrier with the gas nozzle 1017. As such, a portion of the inner surface 1009 may be designed to be substantially free of flowing fluid. For example, with reference to FIG. 10, the inner surface 1009 clockwise from the gas nozzle 1017 to the fluid nozzle 1007 can be designed to be substantially free of liquid. On the other hand, liquid can be maintained along the inner surface 1009 clockwise from the fluid nozzle 1007 and the fluid source 1011. As such, fluid can be encouraged to be removed by one of the exit ports 1515*a*, 1515*b* and be prevented from cycling around the inner peripheral wall for further exposure to additional particles at the machining location.

Various aspects of the disclosure discusses above can facilitate finishing techniques that involve machining glass while maintaining the pristine surfaces of the glass sheet. Aspects of the disclosure address various particle source concerns such as: (1) glass particles generated at the edge of the glass during machining; (2) particles including the grinding and polishing coolant; (3) flying particles in the air; and (4) working wheel particles released during the machining process out such finishing techniques while maintaining the pristine surfaces of the glass sheet.

Certain aspects of the disclosure result in a fluid film, such as a water film that may be introduced by fluid dispensing devices 103, 901 to provide sheet water management on both sides of a glass sheet. The fluid dispensing devices can help maintain the pristine surfaces of the glass sheet by creating an uninterrupted laminar film of water or other fluid to overcome particles sources and particle dynamics from various particle sources. In some examples, the particles may be designed to be removed in less than 2.2 seconds to avoid deposition of the particles on the glass surface. The laminar fluid film (e.g., water film) is designed to provide an uninterrupted laminar fluid film and fluid flow rate to all surface areas of the glass sheet exposed to the various sources of particles.

In the orientation shown in FIG. 1, gravity tends to contribute to biasing particles to engage the upper side of the glass sheet while gravity tends to facilitate removal of particles away from the bottom side of the glass sheet. The fluid dispensing device 103 is designed to provide uninterrupted laminar water film and water flow rate before and after the fluid film lands on the upper surface of the glass sheet. Likewise, the fluid dispensing device 901 also provides uninterrupted laminar water film and water flow rate before and after the fluid film lands on the lower surface of the glass sheet. The uninterrupted laminar water film can help prevent particles from penetrating and/or adhering to the glass surface and can help maintain cleanliness and the pristine surfaces of the glass sheet.

Further aspects of the disclosure provide for a self-cleaning shroud that is effective to contain flying particles and prevents particle accumulation inside the shroud. For example, the shroud can help control flying particles and/or prevent accumulation of working wheel residual particles from accumulating inside the shroud. A water wall can be created within the self-cleaning shroud to flush the surface of the shroud, thereby flushing away particles that may have otherwise caused glass contamination issues. As such, the self-cleaning shroud is not only designed to contain flying particles generated during the machining process, but also timely removes the particles from the vicinity of the glass sheet to avoid accumulation inside the shroud that may otherwise present a contamination source of accumulated particles.

Still further aspects of the disclosure provide for one or more fluid (e.g., water) cleaning jets that are designed to strip particles from the working wheel so that the particles do not accumulate and thereafter redeposit on the glass surface at a later time. The water jets can facilitate stripping particles from the working wheel to prevent flying particles and accumulation of particles within the shroud. In some examples, the wheel cleaning jets can be orientated within a range of from about −30° to about +30° to facilitate maximum stripping of particles from the rotating working wheel. Other angles can be provided in further examples depending on the wheel orientation, the glass edge configuration, etc.

Further aspects of the disclosure provide for a shroud with one or more exit ports in the outer cylindrical peripheral wall designed to help reduce the residence time of the water and entrained particles within the containment area of the shroud.

Figure 17:
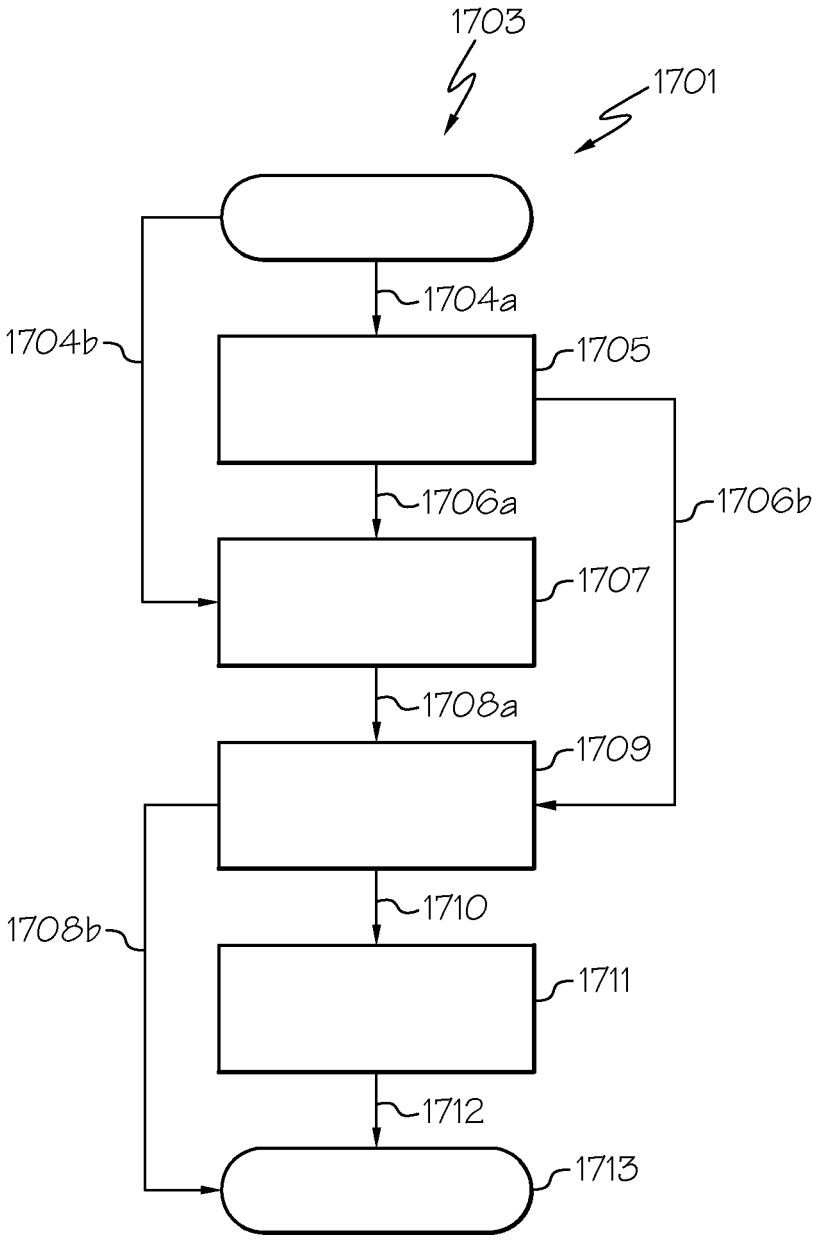
FIG. 17 is an example flow chart illustrating example steps of methods of treating glass in accordance with examples of the disclosure

Methods of treating glass are discussed with respect to the flow chart 1701 shown in FIG. 17. The method begins at step 1703. As indicated by arrow 1704*a*, the method can optionally begin by with step 1705 of machining the surface portion (e.g., edge portion) of the glass sheet by grinding the surface portion of the glass sheet with the first rotating grinding wheel of the first upstream working device 101*a*. Grinding the surface portion of the glass sheet can be carried out while dispensing a substantially laminar flow of the first fluid film 109 along the first fluid plane that lands on the first major surface 117 of a glass sheet 119. Debris from grinding the surface portion is entrained in the first fluid film 109 traveling along the first major surface 117 of the glass sheet and carried away from the glass sheet 111.

After step 1705, as indicated by arrow 1706*a*, the method can then proceed to the step 1707 of polishing the surface portion of the glass sheet. Alternatively, as indicated by arrow 1704*b*, the method can optionally begin by with step 1707 of machining the surface portion (e.g., edge portion) of the glass sheet by polishing the surface portion of the glass sheet with the first rotating grinding wheel of the second upstream working device 101*b*. Polishing the surface portion of the glass sheet can be carried out while dispensing a substantially laminar flow of the first fluid film 109 along the first fluid plane that lands on the first major surface 117 of a glass sheet 119. Debris from polishing the surface portion is entrained in the first fluid film 109 traveling along the first major surface 117 of the glass sheet and carried away from the glass sheet 111.

After step 1707, as indicated by arrow 1708*a* the method can then proceed to the step 1709 of cleaning the surface portion of the glass sheet. Alternatively, as indicated by arrow 1706*b* the method can proceed directly from the step 1705 of grinding to the step 1709 of cleaning. During the step 1709 of cleaning, the downstream working device 101*c* machines the surface portion of the glass sheet with the working surface of the cleaning wheel. Indeed, during step 1709, the downstream working device 101*c* machines the surface portion of the glass sheet by cleaning the surface portion of the glass sheet to remove further debris generated during step 1705 and/or step 1707.

As indicated by arrow 1708*b*, the method can end at 1713 after the step 1709 of cleaning. Alternatively, as indicated by arrow 1710, the method can then proceed from the step 1709 of cleaning to a step 1711 of washing the glass sheet (e.g., surface portion). As the glass sheet has already been cleaned during step 1709, the step of washing may be required to remove less particles than would be required without the cleaning step 1709. As such, the washing efficiency of the washer used during step 1711 is increased and less burden is imposed on the filtration system of the washing device. In addition, the combination of the step of cleaning 1709 and the step 1711 of washing can remove more particles from the vicinity of the glass sheet than if either of the steps were omitted.

As indicated by arrow 1712, the method can then end at 1713 wherein the glass sheet may then be dried with little, if any, residual particles from the machining procedures being left behind.

Providing the downstream working device 101*c* to clean the surface portion of the glass sheet after machining with the upstream working device(s) 101*a*, 101*b* provides a significant and unexpected improvement of particle removal than relying only on the shroud and/or fluid streams of the upstream working device 101*a*, 101*b* to remove the particles. Indeed, it was determined that the upstream working device disclosed in U.S. Patent Application Publication No. 2013/0130597 (hereinafter the '597 publication), previously incorporated by reference in its entirety, as particularly effective to remove machined particles. Indeed, the disclosure of the '597 publication allows particles generated during grinding/polishing to be efficiently removed by being entrained in the fluid film and contained within the shroud. However, it was discovered that a further machining procedure (cleaning) with the downstream working device 101*c* significantly improved particle removal from the vicinity of the glass sheet during the machining procedure.

As such, a downstream cleaning device as disclosed herein provides even further benefits of significant reduction in particle density than when compared to the single working device set forth by the '597 publication. As such, less particles are left behind that may otherwise effect the surface quality of the glass sheet. Moreover, during the subsequent optional washing step 1711, the amount of glass particles entering the washer can be reduced which makes the washer more efficient and less burden is imposed on the washer filtration system.

It will be apparent to those skilled in the art that various modifications and variations can be made without departing from the spirit and scope of the claimed invention.

What is claimed is:

1. A glass treatment apparatus comprising:

at least one upstream working device including a working wheel configured to rotate such that a working surface of the working wheel machines an outer peripheral edge of a glass sheet, and a shroud substantially circumscribing the working wheel, wherein the shroud includes a slot configured to receive the outer peripheral edge of the glass sheet; and a downstream working device positioned downstream from the at least one upstream working device, wherein the downstream working device includes a farthest downstream working wheel comprising a cleaning wheel configured to rotate such that a working surface of the cleaning wheel machines the outer peripheral edge of the glass sheet by cleaning the outer peripheral edge of the glass sheet to remove debris generated by machining the outer peripheral edge of the glass sheet with the at least one upstream working device without further removal of glass from the outer peripheral edge of the glass sheet, the downstream working device further including a shroud substantially circumscribing the cleaning wheel that includes a slot configured to receive the outer peripheral edge of the glass sheet.

2. The glass treatment apparatus of claim 1, wherein the working wheel of at least one of the upstream working devices comprises a grinding wheel.

3. The glass treatment apparatus of claim 1, wherein the working wheel of at least one of the upstream working devices comprises a polishing wheel.

4. The glass treatment apparatus of claim 1, wherein the at least one upstream working device comprises a first upstream working device and a second upstream working device, wherein the working wheel of the first upstream working device comprises a grinding wheel and the working wheel of the second upstream working device comprises a polishing wheel, and wherein the second upstream working device is positioned midstream between the first upstream working device and the downstream working device.

5. The glass treatment apparatus of claim 1, further including a fluid dispensing device configured to direct a laminar fluid film along a major surface of the glass sheet to freely travel through an upper area of the slot of the shroud of the at least one upstream working device.

6. The glass treatment apparatus of claim 5, further comprising another fluid dispensing device configured to direct fluid along another major surface of the glass sheet.

7. The glass treatment apparatus of claim 1, wherein the working surface of at least one of the working wheel and the cleaning wheel comprises an outer peripheral surface of the wheel.

8. The glass treatment apparatus of claim 4, wherein the first upstream working device further includes a first fluid dispensing device configured to direct a laminar fluid film along a first major surface of the glass sheet, the second upstream working device includes a fluid dispensing device configured to direct a laminar fluid film along the first major surface of the glass sheet, and the downstream working device includes a first fluid dispensing device configured to direct a laminar fluid film along the first major surface of the glass sheet and a second fluid dispensing device configured to direct a laminar fluid film along a second major surface of the glass sheet.

9. A glass treatment apparatus comprising:

at least one upstream working device including a working wheel configured to rotate such that a working surface of the working wheel machines an outer peripheral edge of a glass sheet, and a fluid dispensing device including an elongated opening to define a width of a laminar fluid film along a fluid plane to land on a major surface of the glass sheet; and a downstream working device positioned downstream from the at least one upstream working device, wherein the downstream working device includes a farthest downstream working wheel comprising a cleaning wheel configured to rotate such that a working surface of the cleaning wheel machines the outer peripheral edge of the glass sheet by cleaning the outer peripheral edge of the glass sheet to remove debris generated by machining the outer peripheral edge of the glass sheet with the at least one upstream working device without further removal of glass from the outer peripheral edge of the glass sheet, the downstream working device further including a shroud substantially circumscribing the cleaning wheel that includes a slot configured to receive the outer peripheral edge of the glass sheet.

10. The glass treatment apparatus of claim 9, wherein the at least one upstream working device further comprises another fluid dispensing device configured to direct fluid along another major surface of the glass sheet.

11. The glass treatment apparatus of claim 9, wherein the downstream working device includes a fluid dispensing device configured to direct a laminar fluid film along the major surface of the glass sheet.

12. The glass treatment apparatus of claim 11, wherein the downstream working device includes another fluid dispensing device configured to direct fluid along another major surface of the glass sheet.

13. The glass treatment apparatus of claim 9, wherein the at least one upstream working device comprises a first upstream working device and a second upstream working device, wherein the working wheel of the first upstream working device comprises a grinding wheel and the working wheel of the second upstream working device comprises a polishing wheel, and wherein the second upstream working device is positioned midstream between the first upstream working device and the downstream working device.

14. The glass treatment apparatus of claim 9, wherein the working surface of at least one of the working wheel and the cleaning wheel comprises an outer peripheral surface of the wheel.

15. The glass treatment apparatus of claim 13, wherein the downstream working device includes a first fluid dispensing device configured to direct a laminar fluid film along a first major surface of the glass sheet and a second fluid dispensing device configured to direct a laminar fluid film along a second major surface of the glass sheet.

16. A method of treating glass comprising the steps of:

(I) machining an outer peripheral edge of a glass sheet with a working surface of a first rotating working wheel while dispensing a substantially laminar flow of a first fluid film along a first fluid plane that lands on a first pristine major surface of a glass sheet, wherein debris from machining the outer peripheral edge is entrained in the first fluid film traveling along the first pristine major surface of the glass sheet and carried away from the glass sheet to protect the first pristine major surface from particles generated when machining the outer peripheral edge of the glass sheet; and then (II) machining the outer peripheral edge of the glass sheet with a working surface of a second rotating working wheel substantially circumscribed by a shroud including a slot, the second rotating working wheel comprising a cleaning wheel that machines the outer peripheral edge of the glass sheet received by the slot of the shroud by cleaning the outer peripheral edge of the glass sheet to remove further debris generated during step (I) without further removal of glass from a surface portion of the glass sheet, wherein machining of the glass sheet with working wheels is complete after step (II).

17. The method of claim 16, wherein step (I) comprises machining the outer peripheral edge of the glass sheet by polishing the surface portion of the glass sheet with the first rotating working wheel comprising a rotating polishing wheel.

18. The method of claim 16, wherein prior to step (I), further comprising the step of machining the outer peripheral edge of the glass sheet by grinding the outer peripheral edge of the glass sheet with the first rotating working wheel comprising a rotating grinding wheel.

19. The method of claim 16, wherein, during step (I), the first fluid film lands on the first pristine major surface of a glass sheet at a location outside of another shroud substantially circumscribing the first rotating working wheel shroud and the debris from machining the outer peripheral edge is entrained in the first fluid film inside the another shroud.

20. The method of claim 19, wherein, during step (I), the first fluid film travels through a slot of the another shroud.

21. The method of claim 20, wherein step (I) includes passing the first fluid film with the entrained debris through an exit port in the shroud.

22. The method of claim 16, wherein step (I) further comprises dispensing a substantially laminar flow of a second fluid film along a second fluid plane that lands on a second major surface of the glass sheet, wherein debris from machining the outer peripheral edge is entrained in the second fluid film traveling along the second major surface of the glass sheet and carried away from the glass sheet.

23. The method of claim 22, wherein, during step (I), the second fluid film lands on the second major surface of a glass sheet at a location outside of another shroud substantially circumscribing the first rotating working wheel shroud and the debris from machining the outer peripheral edge is entrained in the second fluid film inside the another shroud.

24. The method of claim 23, wherein, during step (I), the second fluid film travels through a slot of the another shroud.

25. The method of claim 23, wherein step (I) includes passing the second fluid film with the entrained debris through an exit port in the shroud.

26. The method of claim 16, wherein step (II) includes dispensing a substantially laminar flow of a first cleaning fluid film along a first cleaning fluid plane that lands on the first pristine major surface of the glass sheet, wherein at least portions of the further debris is entrained in the first cleaning fluid film traveling along the first pristine major surface of the glass sheet and carried away from the glass sheet.

27. The method of claim 26, wherein step (II) further includes dispensing a substantially laminar flow of a second cleaning fluid film along a second cleaning fluid plane that lands on the second major surface of the glass sheet, wherein at least portions of the further debris is entrained in the second cleaning fluid film traveling along the second major surface of the glass sheet and carried away from the glass sheet.

28. The method of claim 16, wherein, during step (I), the first fluid film travels along a fluid plane at an angle "A1" relative to the first pristine major surface of the glass sheet and then lands on the first pristine major surface of a glass sheet at a location outside of another shroud substantially circumscribing the first rotating working wheel and the debris from machining the outer peripheral edge is entrained in the first fluid film inside the another shroud.

29. The method of claim 28, wherein the angle "A1" is within a range from 0° to 30° and the first fluid film travels through a slot of the another shroud during step (I).

* * * * *